US008714680B2

(12) United States Patent
Narumi et al.

(10) Patent No.: US 8,714,680 B2
(45) Date of Patent: May 6, 2014

(54) INKJET RECORDING APPARATUS AND INKJET RECORDING METHOD

(75) Inventors: Kazuki Narumi, Kawasaki (JP); Takumi Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/493,764

(22) Filed: Jun. 11, 2012

(65) Prior Publication Data

US 2012/0249678 A1 Oct. 4, 2012

Related U.S. Application Data

(63) Continuation of application No. 12/484,946, filed on Jun. 15, 2009, now Pat. No. 8,215,740.

(30) Foreign Application Priority Data

Jun. 19, 2008 (JP) ..... 2008-160772

(51) Int. Cl.
*B41J 29/38* (2006.01)
*B41J 2/205* (2006.01)
*B41J 23/00* (2006.01)

(52) U.S. Cl.
USPC ..... 347/14; 347/15; 347/37

(58) Field of Classification Search
USPC ..... 347/14, 15, 37, 43, 100
See application file for complete search history.

(56) References Cited

U.S. PATENT DOCUMENTS

2003/0151642 A1* 8/2003 Kaneko ..... 347/43
2008/0248260 A1* 10/2008 Kojima et al. ..... 347/84

FOREIGN PATENT DOCUMENTS

JP 2002-011862 A 1/2002
JP 2002-337332 A 11/2002
JP 2005-081754 A 3/2005
JP 2005-246877 A 9/2005

* cited by examiner

*Primary Examiner* — Jannelle M Lebron
(74) *Attorney, Agent, or Firm* — Canon USA Inc IP Division

(57) ABSTRACT

Gradation data for each color to be input to a recording apparatus includes dot-recording-position information for every unit pixel and information for determining a nozzle position in a recording head for recording a dot. The information for determining the nozzle position makes determination in accordance with image data of an ink with resin and image data of an ink without resin. In a region where the ink with resin and the ink without resin overlap with each other, the ink without resin can land first.

12 Claims, 19 Drawing Sheets

FIG. 11

| | CMYK DATA (MAX 255) | WEIGHTING COEFFICIENT | WEIGHTING COEFFICIENT RESULT | CALCULATION CONSTANT B | NUMERICAL VALUE AFTER CALCULATION PROCESSING | INTERMEDIATE MASK SELECTION PARAMETER (MP') |
|---|---|---|---|---|---|---|
| DATA EXAMPLE 1 | C=10 | C=0.5 M=0.12 | C'=5 | 180 | 205 | 25 |
| | M=255 | | M'=30 | | | |
| DATA EXAMPLE 2 | C=40 | | C'=20 | | 164 | 20 |
| | M=40 | | M'=4 | | | |
| DATA EXAMPLE 3 | C=255 | | C'=127 | | 54 | 6 |
| | M=10 | | M'=1 | | | |

FIG. 12

| INK | MASK SELECTION PARAMETER (MP) | MASK TO BE USED |
|---|---|---|
| CYAN | 0 | NORMAL MASK |
| | 1 | LATER-RECORDING MASK |
| MAGENTA | | NORMAL MASK |

FIG. 14

| | CMYK DATA | | ONLY NORMAL MASK | | M: NORMAL MASK<br>C: LATER-RECORDING MASK | | PRESENT EMBODIMENT<br>(MASK IS CHANGED PER PIXEL) | | |
|---|---|---|---|---|---|---|---|---|---|
| | | | UNEVENNESS (RESIN) | UNEVENNESS (OVERFLOW) | UNEVENNESS (RESIN) | UNEVENNESS (OVERFLOW) | MASK TO BE USED | UNEVENNESS (RESIN) | UNEVENNESS (OVERFLOW) |
| DATA EXAMPLE 1 | C | 10 | △ | ○ | ○ | ○ | MAINLY LATER-RECORDING MASK | ○ | ○ |
| | M | 255 | | | | | | | |
| DATA EXAMPLE 2 | C | 40 | △ | ○ | ○ | ○ | HALF NORMAL MASK AND HALF LATER-RECORDING MASK | ○ | ○ |
| | M | 40 | | | | | | | |
| DATA EXAMPLE 3 | C | 255 | ○ | ○ | ○ | △ | ONLY NORMAL MASK | ○ | ○ |
| | M | 5 | | | | | | | |

FIG. 16

| | MASK SELECTION PARAMETER (MP) | INK | MASK TO BE USED |
|---|---|---|---|
| DATA EXAMPLE 1 | 0 | WITHOUT RESIN | NORMAL MASK |
| | | WITH RESIN | NORMAL MASK |
| DATA EXAMPLE 2 | 1 | WITHOUT RESIN | FORMER-RECORDING MASK |
| | | WITH RESIN | LATER-RECORDING MASK |

INKJET RECORDING APPARATUS AND INKJET RECORDING METHOD

CROSS REFERENCE TO RELATED APPLICATIONS

This application is a Continuation of U.S. patent application Ser. No. 12/484,946 filed Jun. 15, 2009, which claims priority to Japanese Patent Application No. 2008-160772 filed Jun. 19, 2008, both of which are hereby incorporated by reference herein in their entireties.

BACKGROUND OF THE INVENTION

1. Field of the Invention

The present invention relates to an inkjet recording apparatus and an inkjet recording method for performing recording with a recording head that discharges ink.

2. Description of the Related Art

An inkjet recording apparatus is an advantageous recording type which is capable of providing a high-density and high-speed recording operation, with low operating cost and low noise. Hence, such inkjet recording apparatuses are commercialized as output apparatuses in various forms.

A coloring agent applied to ink for inkjet recording is a water-soluble dye in view of an image quality such as saturation and color reproducibility of a colorant, a variety of colorants to be used, solubility to water, and ejection reliability like nozzle clogging. However, specifications, such as light resistance and water resistance, of a dye may be insufficient, and a recorded object recorded with dye ink may have insufficient light resistance and water resistance. A pigment has the light resistance and water resistance which are superior to those of the dye. In recent years, the pigment has been used as a coloring agent applied to ink for inkjet recording so as to increase the light resistance and water resistance. Regarding a recorded object recorded with pigment ink, the pigment ink remains on a surface of a recording medium unlike the dye ink which permeates into the recording medium. It is difficult to have scratch resistance which represents resistance of an image when the recorded object is scratched with a nail or rubbed with cloth or the like. Owing to this, to increase the scratch resistance of the recorded object recorded with the pigment ink, a technique has been suggested, in which resin is added to ink, thereby achieving the increase in scratch resistance.

For example, Japanese Patent Laid-Open No. 11-349875 suggests a technique in which an ink composition includes fine polymer (resin) particles having a ligand structure capable of forming a metal ion and a chelate. With the technique, the ink composition adheres to a recording medium, and water and a water-soluble organic solvent near the fine polymer particles permeate into the recording medium. A film, in which the fine resin particles are subjected to coalescence and fusion and which includes a coloring material, is formed on the recording medium. Thus, an obtained image has high scratch resistance and high water resistance.

SUMMARY OF THE INVENTION

Adding resin into ink can increase the strength of an image layer of the ink. It is markedly effective to increase fastness, such as water resistance and scratch resistance.

However, when an image is recorded with the ink with resin added, it has been found that an irregular gap, and a dot with an increased ink density appear on a recording medium, resulting in density unevenness appearing in a recorded image.

The present invention decreases the density unevenness which is generated when the ink with resin added is used. Thus, the invention provides a recording apparatus capable of increasing fastness and decreasing image degradation so as to obtain a recorded object with high fastness.

According to an aspect of the invention, an inkjet recording apparatus includes a recording unit configured to cause a recording head to discharge a first ink and a second ink; and a scanning unit configured to cause the recording head to scan a recording medium. An ink-remaining likelihood of the second ink on the first ink is higher than an ink-remaining likelihood of the first ink on the second ink. The recording unit performs recording with the first ink and the second ink in that order in at least one of a plurality of pixels to be recorded with the first ink and the second ink.

According to another aspect of the invention, an inkjet recording method includes recording an image on a recording medium by discharging a first ink and a second ink by a recording head. An ink-remaining likelihood of the second ink on the first ink is larger than an ink-remaining likelihood of the first ink on the second ink. Recording is performed with the first ink and the second ink in that order in at least one of a plurality of pixels to be recorded with the first ink and the second ink.

With the aspects, when an image is recorded with at least two types of inks having different characteristics, the application order of the inks in the same pixel region of a recording medium is controlled. Accordingly, image quality such as density unevenness can be increased.

Further features of the present invention will become apparent from the following description of exemplary embodiments with reference to the attached drawings.

BRIEF DESCRIPTION OF THE DRAWINGS

FIG. 11 is a table showing the mask selection processing according to the first embodiment.

FIG. 12 is a table showing a mask selection parameter and a mask pattern to be selected according to the first embodiment.

FIG. 14 is a table showing an effect of the first embodiment.

FIG. 16 is a table showing a mask selection parameter and a mask pattern to be selected according to the first embodiment.

DESCRIPTION OF THE EMBODIMENTS

First Embodiment

A first embodiment of the present invention will be described below with reference to the drawings.

(General Configuration)

Figure 1:
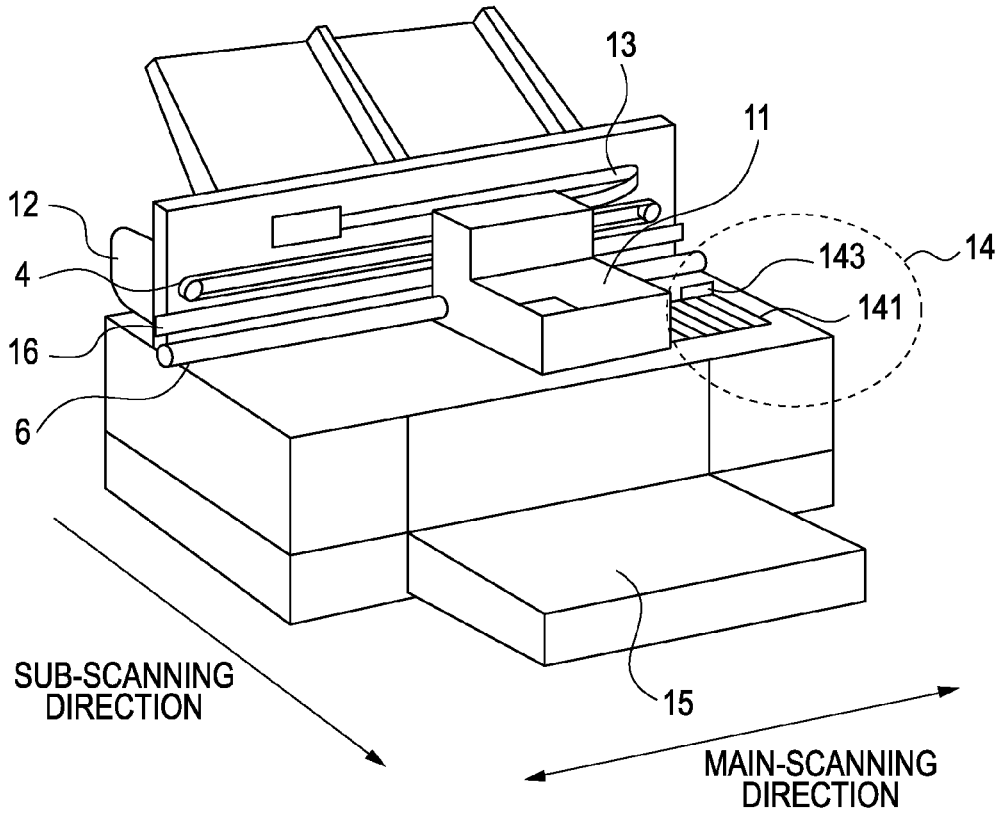
FIG. 1 is a general configuration diagram showing an inkjet recording apparatus to which the present invention is applicable.

FIG. 1 is an illustration showing a general configuration of an inkjet recording apparatus according to this embodiment. A carriage 11, on which a recording head (not shown) and an ink tank are mounted, includes a connector holder (electric connection portion) which transmits a driving signal etc. to the recording head. The driving signal is transmitted through a flexible cable 13 from a record control unit. The carriage 11 is guided and supported along a guide shaft 6 which is provided in an apparatus body and extends in a main-scanning direction. The carriage 11 reciprocates by a main-scanning motor 12 using a driving mechanism such as a timing belt 4. The position and movement of the carriage 11 are controlled using an encoder sensor 16 which optically reads the position of the carriage 11. A recovery section 14 is provided at an end in a movable region of the carriage 11. The recovery section 14 performs maintenance processing for the recording head. The recovery section 14 includes a cap 141 which protects a discharge surface of the recording head during suction and in a non-operating state, and a wiper blade 143 which wipes the discharge surface of the recording head. Recording media, such as print sheets or plastic thin plates, are separated one by one and fed from a sheet-feed tray 15, and the fed sheet is conveyed by a sheet-feed roller (not shown) in a sub-scanning direction. For example, the recording head discharges ink using thermal energy. Thus, the recording head includes an electrothermal transducer which generates thermal energy. In particular, the recording head uses a pressure of an air bubble generated by film boiling because of thermal energy which is applied to the recording head by the electrothermal transducer. Thusly, the recording head performs printing by discharging ink from discharge ports (nozzles). Of course, another method can be employed, such as a method of discharging ink using a piezoelectric element.

Figure 2:
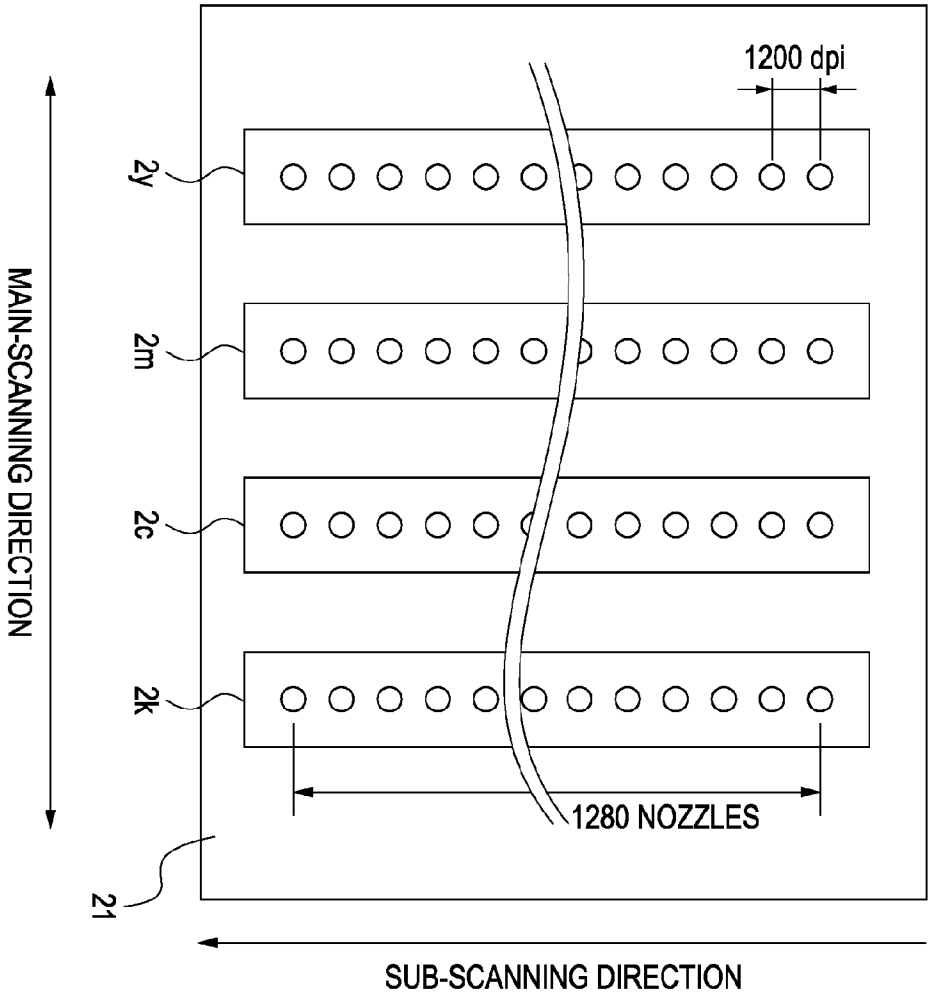
FIG. 2 is a schematic illustration showing a recording head having a lateral arrangement.

FIG. 2 is a schematic illustration showing nozzles of a recording head 21 in this embodiment. The recording head 21 of this embodiment has a nozzle array for each color, in which 1280 nozzles are arranged in the sub-scanning direction with a density of 1200 nozzles per inch. A nozzle array 2*k* for discharging black ink, a nozzle array 2*c* for discharging cyan ink, a nozzle array 2*m* for discharging magenta ink, and a nozzle array 2*y* for discharging yellow ink are arranged in parallel to the main-scanning direction of the recording head 21. A discharging amount of ink to be discharged from a nozzle is about 4.5 pl. To achieve a high density for the black ink, the discharging amount of the black ink may be slightly increased as compared with the discharging amounts of ink of other colors. In the recording apparatus of this embodiment, the recording head discharges ink while scanning in the main-scanning direction. Accordingly, dots can be recorded with a recording density of 2400 dpi (dot/inch) in the main-scanning direction and 1200 dpi in the sub-scanning direction.

With the use of the recording head 21, the recording apparatus of this embodiment typically performs recording by repeating a recording operation in which the recording head discharges ink while the carriage scans in the main-scanning direction, and a conveying operation in which a recording medium is conveyed by a predetermined amount in a conveying direction. Further, an image is recorded on a recording medium by multipath recording. The multipath recording is a recording method in which the recording head scans a unit region on a recording medium by a plurality of scanning operations, and the recording medium is conveyed by an amount corresponding to the unit region during the plurality of scanning operations. A plurality of nozzles of the recording head 21 may vary in ink-discharging directions and ink-discharging amounts, the variation occurring in a manufacturing process. Also, a sub-scanning amount performed during the recording scanning may contain an error resulted from the structure. The error and variation may result in image defect, such as stripes or density unevenness, in a recording medium recorded with ink. Since the multipath recording is employed, in which an image is recorded in a region by a plurality of scanning operations although the region could be recorded by a single recording scanning operation, even when the discharging characteristics of the nozzles vary and conveying amounts vary, the characteristics are diffused to the entire image and are hardly recognized.

(Ink Composition)

Components and refining methods of an ink set applied to this embodiment will now be described. Here, magenta, yellow, and black inks are inks without resin, and only a cyan ink is an ink with resin in which resin is added for increasing scratch resistance.

<Yellow Ink>

(1) Preparation of Dispersion Liquid

First, 10 parts of pigment (details given below), 30 parts of anionic polymer (details given below), and 60 parts of pure water are mixed.

Pigment: [Pigment Yellow 74 (color index, C.I.), Hansa Brilliant Yellow 5GX (product name), manufactured by Clariant], 10 parts Anionic polymer P-1: [styrene/butyl acrylate/acrylic acid copolymer (copolymerization ratio (weight ratio)=30/40/30), acid number of 202, weight-average molecular weight of 6500, water solvent with solid content of 10%, corrective agent of potassium hydroxide], 30 parts The above-mentioned materials are placed in a batch type vertical sand mill (manufactured by Aimex Co., Ltd.), 150 parts of zirconia beads with a diameter of 0.3 mm are filled, and disperse processing is performed for 12 hours under water cooling. Then, the dispersion liquid is processed by a centrifugal separator, whereby removing coarse particles. Accordingly, a pigment dispersion element with a solid content of about 12.5% and an average particle diameter by weight of 120 nm is obtained as a finally refined object. Using the obtained yellow pigment dispersion liquid, ink is prepared as follows.

(2) Preparation of Ink

The following components are mixed, sufficiently stirred to dissolve and disperse the components, and filtered under a pressure using a micro filter (manufactured by Fujifilm Corporation) with a pore size of 1.0 μm, thereby preparing an ink.

Yellow dispersion liquid (described above), 40 parts
Glycerin, 9 parts
Ethylene glycol, 6 parts
Acetylenol (product name, Acetylenol EH, manufactured by Kawaken Fine Chemicals Co., Ltd.), 1 part
1,2-hexanediol, 3 parts
Polyethylene glycol (molecular weight of 1000) 4 parts
Ion-exchange water, 37 parts <Magenta Ink>

(1) Preparation of Dispersion Liquid

First, using benzyl acrylate and methacrylic acid as materials, AB block resin with an acid number of 300 and a number-average molecular weight of 2500 is made by an ordinary method, is neutralized in an aqueous solution of potassium hydroxide, and is diluted by the ion-exchange water, thereby making an equalized aqueous resin solution by 50 wt %. Also, 100 g of the above-mentioned aqueous solution, 100 g of C.I. Pigment Red 122, and 300 g of ion-exchange water are mixed, and mechanically stirred for 0.5 hour. Then, using a micro fluidizer, the mixture is processed by causing the mixture to pass through an interaction chamber five times under a liquid pressure of about 70 MPa. Further, the obtained dispersion liquid is centrifuged (at 12000 rpm for 20 minutes), thereby removing non-dispersion substances including coarse particles, to obtain magenta dispersion liquid. The obtained magenta dispersion liquid has a pigment density of 10 wt % and a dispersant density of 5 wt %.

(2) Preparation of Ink

Ink is prepared by using the above-mentioned magenta dispersion liquid. The following components are added to the magenta dispersion liquid to achieve a predetermined density. The components are sufficiently mixed and stirred, filtered under a pressure using a micro filter (manufactured by Fujifilm Corporation) with a pore size of 2.5 μm, thereby preparing a pigment ink with a pigment density of 4 wt % and a dispersant density of 2 wt %.

Magenta dispersion liquid (described above), 40 parts
Glycerin, 10 parts
Diethylene glycol, 10 parts
Acetylenol (manufactured by Kawaken Fine Chemicals Co., Ltd.), 0.5 part
Ion-exchange water, 39.5 parts <Black Ink>

(1) Preparation of Dispersion Liquid

First, 100 g of the polymer solution used for the yellow ink, 100 g of carbon black, and 300 g of ion-exchange water are mixed, and mechanically stirred for 0.5 hour. Then, using a micro fluidizer, the mixture is processed by causing the mixture to pass through an interaction chamber five times under a liquid pressure of about 70 MPa. Further, the obtained dispersion liquid is centrifuged (at 12000 rpm for 20 minutes), thereby removing non-dispersion substances including coarse particles, to obtain black dispersion liquid. The obtained black dispersion liquid has a pigment density of 10 wt % and a dispersant density of 6 wt %.

(2) Preparation of Ink

Ink is prepared by using the above-mentioned black dispersion liquid. The following components are added to the black dispersion liquid to achieve a predetermined density. The components are sufficiently mixed and stirred, filtered under a pressure using a micro filter (manufactured by Fujifilm Corporation) with a pore size of 2.5 μm, thereby preparing a pigment ink with a pigment density of 5 wt % and a dispersant density of 3 wt %.

Black dispersion liquid (described above), 50 parts
Glycerin, 10 parts
Triethylene glycol, 10 parts
Acetylenol (manufactured by Kawaken Fine Chemicals Co., Ltd.), 0.5 part
Ion-exchange water, 25.5 parts <Cyan Ink>

(1) Preparation of Dispersion Liquid

First, using benzyl acrylate and methacrylic acid as materials, AB block polymer with an acid number of 250 and a number-average molecular weight of 3000 is made by an ordinary method, is neutralized in an aqueous solution of potassium hydroxide, and is diluted by the ion-exchange water, thereby making an equalized aqueous resin solution by 50 wt %. Also, 180 g of the above-mentioned aqueous solution, 100 g of C.I. Pigment Blue 15:3, and 220 g of ion-exchange water are mixed, and mechanically stirred for 0.5 hour. Then, using a micro fluidizer, the mixture is processed by causing the mixture to pass through an interaction chamber five times under a liquid pressure of about 70 MPa. Further, the obtained dispersion liquid is centrifuged (at 12000 rpm for 20 minutes), thereby removing non-dispersion substances including coarse particles, to obtain cyan dispersion liquid. The obtained cyan dispersion liquid has a pigment density of 10 wt % and a dispersant density of 10 wt %.

Also, an aqueous resin solution is obtained as follows. A resin, which is made of styrene, n-butyl acetate, and acrylic acid, is prepared by 15.0 wt %, potassium hydroxide is added by one equivalent amount to carboxylic acid constituting the acrylic acid, and water is added such that the total amount achieves 100.0 wt %. Then, the resultant is stirred at 80° C. to dissolve the resin. Then, the resultant are adjusted such that a solid content (resin) achieves 15.0 wt %, and hence, an aqueous resin solution is obtained.

The resin is configured as follows: styrene/n-butyl acetate/acrylic acid=0.160/0.710/0.130, acid number of 101, and weight-average molecular weight of 7000.

(2) Preparation of Ink

The following components including the obtained cyan dispersion liquid and the aqueous resin solution are sufficiently mixed and filtered, thereby preparing an ink.

Cyan dispersion liquid (described above), 16.7 parts
Aqueous resin solution, 16.7 parts
Glycerin, 5.0 parts
Ethylene urea, 9.0 parts
BC20, 1.5 parts
Acetylenol (manufactured by Kawaken Fine Chemicals Co., Ltd.), 0.5 part
Ion-exchange water, 50.6 parts The resin contained in the aqueous resin solution is compounded by dropping a mixture of styrene/ethyl acrylate/acrylic acid/initiator (azobisbutyronitrile) into toluene, and polymerizing at a reflux temperature.

In the specification, an ink containing resin which is added in a later process, in addition to resin contained in dispersion liquid is called "ink with resin". Also, an ink when an ink composition contains resin only in dispersion liquid is called "ink without resin".

(Configuration Example of Image Processing System)

Figure 3:
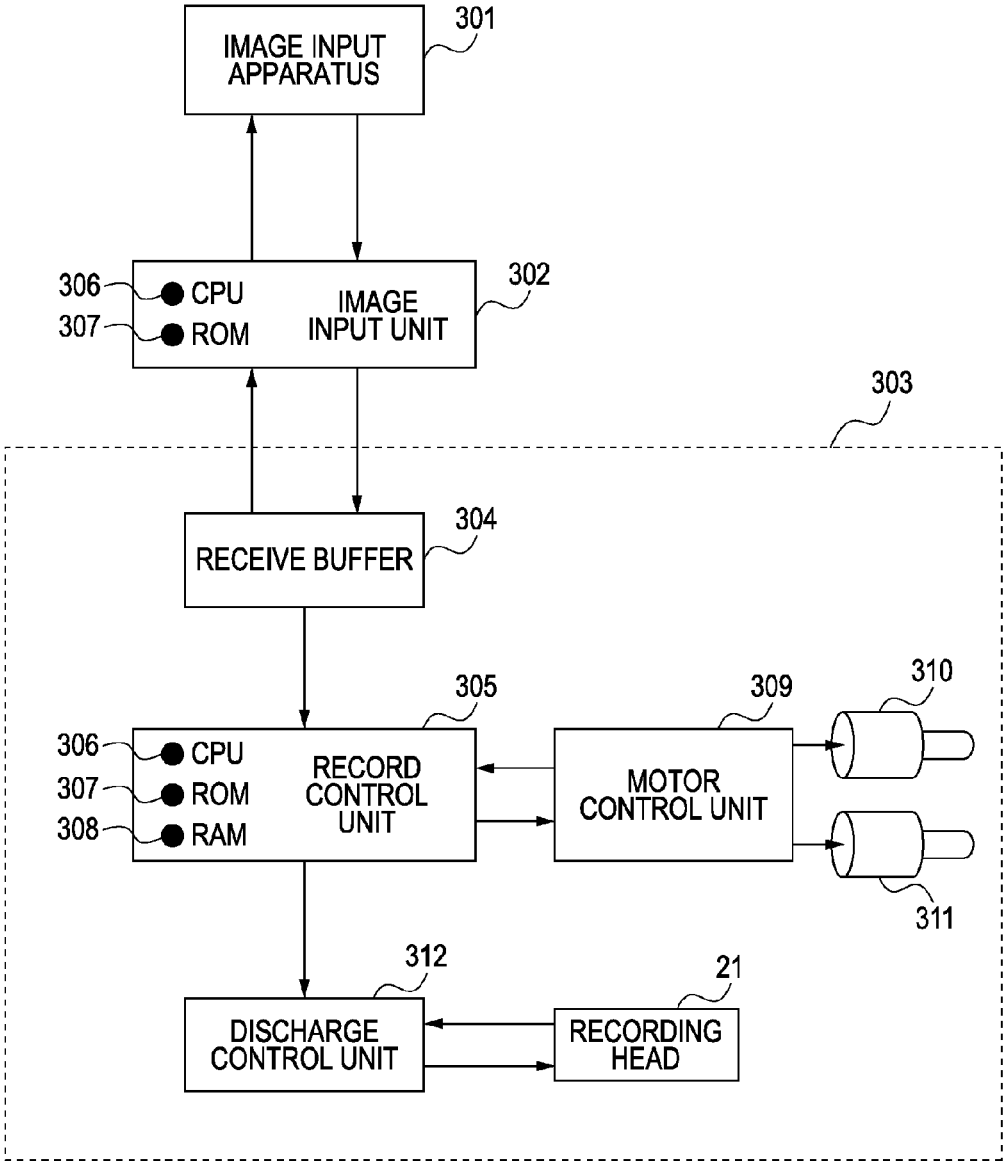
FIG. 3 is a block diagram showing a control configuration of the inkjet recording apparatus.

FIG. 3 is a block diagram showing a configuration of a control system of the inkjet recording apparatus shown in FIG. 1. Maltivalued image data stored in an image input apparatus 301, such as a scanner or a digital camera, or in any of various recording media, such as hard disk, is input to an image input unit 302. The image input unit 302 is a host computer connected to an external device. The image input unit 302 transfers image information to be recorded, to an image output unit 303 (recording apparatus). In addition, the image input unit 302 includes a CPU 306 and a storage element (ROM) 307, which are used when an image is transferred. The host computer may be a computer serving as an information processing device, or an image reader. A receive buffer 304 is an area for temporarily storing data from the image input unit 302. The receive buffer 304 stores received data until a record control unit 305 reads the data. Arranged in the record control unit 305 are a CPU 306, a storage element (ROM 307) which stores a control program and a mask pattern (described later), and a RAM 308 serving as a work area for various image processing. The record control unit 305 applies image processing (described later) to the maltivalued image data read from the receive buffer 304, to convert the maltivalued image data into binarized output image data 404. The record control unit 305 also controls a carriage motor 310 for driving the recording head 21 in the main-scanning direction, and a conveyance motor 311 for conveying a recording medium in the sub-scanning direction through a motor control unit 309. A discharge control unit 312 controls operation of the recording head 21 on the basis of binalized output image data converted by the record control unit 305, so that ink is applied and image formation is performed.

Figure 4:
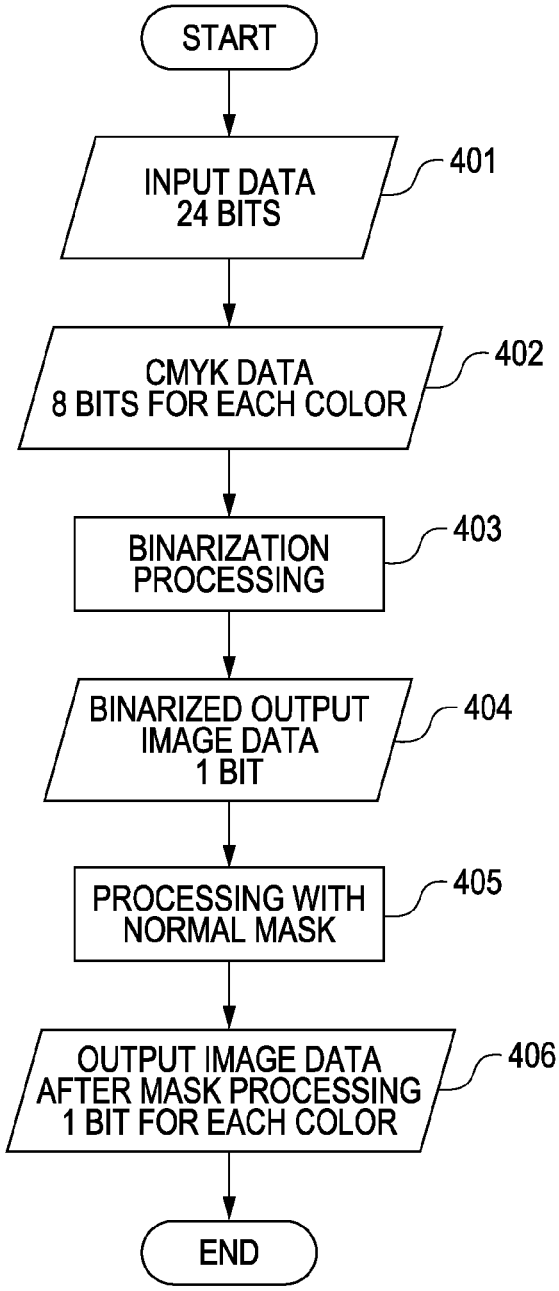
FIG. 4 is a flowchart showing image processing of the inkjet recording apparatus.

FIG. 4 is a flowchart showing a procedure of the record control unit 305. Rectangles indicate individual image processing steps, whereas parallelograms indicate data. First, input data 401 having brightness information of RGB (red, green, blue) is received from an application software operable in the image input apparatus 301. Then, the input data 401 is converted into multivalued CMYK data 402 corresponding to a plurality of inks of cyan (C), magenta (M), yellow (Y), and black (K) used for image recording. The CMYK data 402 is, for example, 8-bit data having a gradation level of about 256 gradations. In this embodiment, the data has a resolution of 600 dpi. In the specification, a pixel having a gradation value input from the recording apparatus and having a resolution of 600 dpi for each of vertical and horizontal sides is hereinafter referred to as a "unit pixel".

With binarization processing 403, the CMYK data is converted into 1-bit binarized output image data 404 which determines a recording position of a dot recordable by the recording head 21. The binarization processing 403 may be typical multivalue error-diffusion processing. In this embodiment, when the binarization processing 403 is to be performed, a unit pixel having the resolution of 600 dpi for each of the vertical and horizontal sides is converted into a pixel having a resolution of 2400 dpi in a main-scanning direction and 1200 dpi in a sub-scanning direction. That is, a region of a unit pixel corresponds to a region of a recording-pixel group of 4×2 pixels (main-scanning×sub-scanning). On the basis of the binarized output image data 404, processing with a mask pattern (described later) 405 is performed, thereby creating output image data 406. In the specification, a recording pixel, in which recording or non-recording of a dot is determined, may be merely referred to as a pixel.

Figure 5:
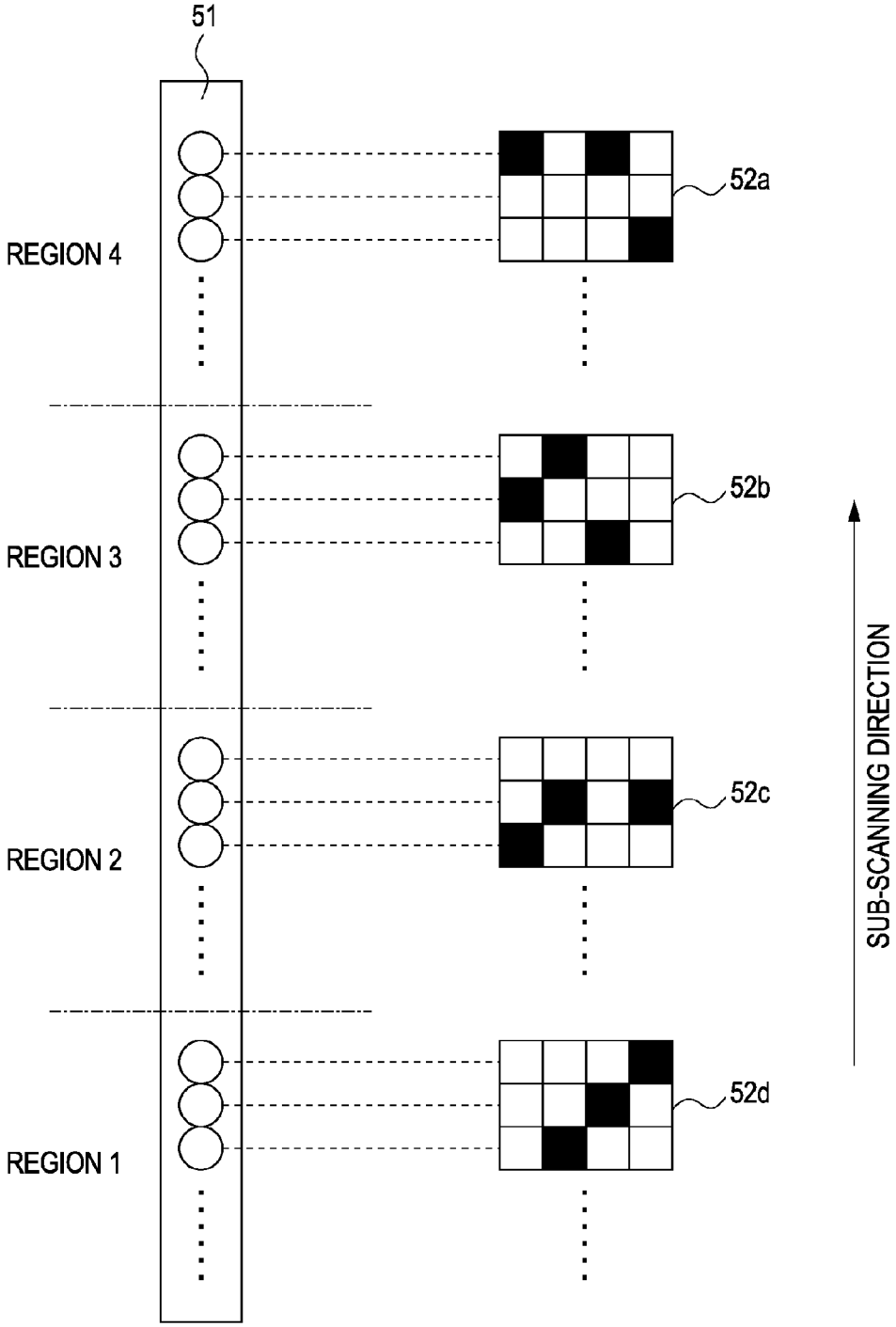
FIG. 5 illustrates an example of a mask pattern to be used when multipath recording with 4 paths is performed.

Referring to FIG. 5, processing with a mask pattern is described in detail. A mask pattern is stored in the ROM 307 in the record control unit 305. Using the mask pattern, the binarized output image data of each color is divided and distributed into recording scanning operations, so that the output image data 406 recorded with each color is generated for every recording scanning operation. FIG. 5 illustrates an example of a mask pattern to be used when multipath recording with 4 paths is performed. For easier understanding, illustrated are a nozzle array 51 for a single color and mask patterns 52*a* to 52*d* corresponding to the nozzle array 51. A plurality of nozzles contained in the nozzle array 51 are divided into 4 regions. Nozzles contained in the respective regions record dots on the basis of the output image data 406 in accordance with the mask patterns 52*a* to 52*d*. The mask patterns 52*a* to 52*d* each include dot-recording-permitted pixels and dot-recording-inhibited pixels. Black regions represent the dot-recording-permitted pixels and white regions represent the dot-recording-inhibited pixels. The four-type mask patterns 52*a* to 52*d* are complemented with each other. A logical product of the mask pattern and the binarized output image data 404 after the binarization processing is obtained for each recording scanning operation. Hence, pixels to be actually recorded during the recording scanning operation is determined. That is, dots are recorded on pixels where dot recording is determined in the binarized output image data 404 and where recording is permitted by the mask pattern. For easier understanding, the illustrated mask pattern has a region of 4×3 pixels. However, an actual mask pattern may have a larger region in the main-scanning direction and the sub-scanning direction.

(Feature Configuration)

With the studies of the inventors, it was found that, when a pigment ink with resin added is used, an ink is interrupted from permeating into a recording medium at a landing position after the pigment ink with resin added (hereinafter, referred to as ink with resin) lands on the position of the recording medium. This phenomenon is described with a model shown in FIGS. 7A and 7B.

Figure 7A:
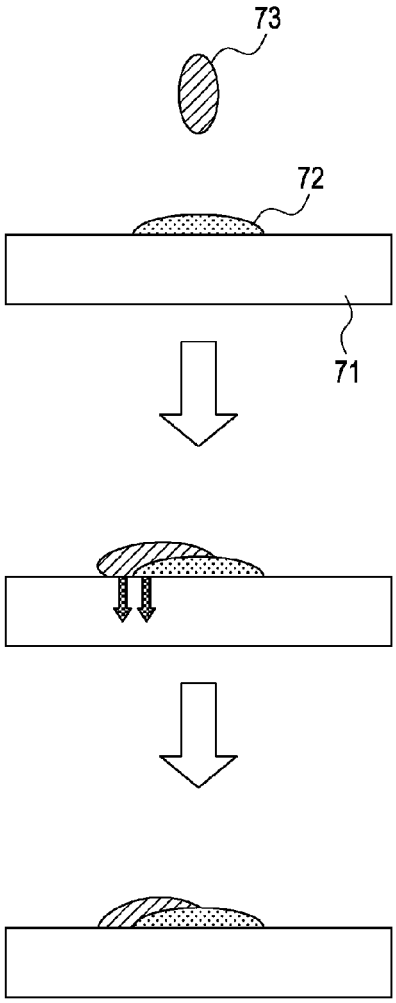
FIGS. 7A and 7B are schematic illustrations each showing a difference between a behavior of a dot of an ink with resin and a behavior of a dot of an ink without resin depending on a landing order according to the first embodiment.
Figure 7B:
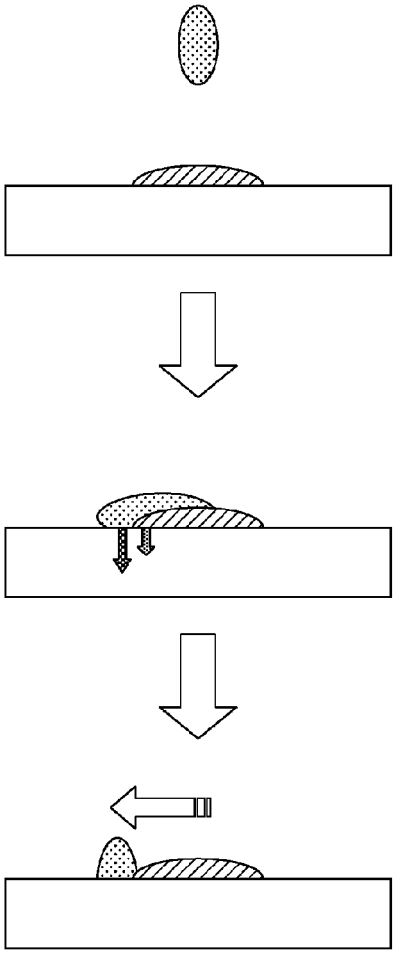

FIGS. 7A and 7B illustrate cases in which two types of dots of a pigment ink 72 (hereinafter, referred to as ink without resin) and an ink with resin 73 overlap with each other. FIG. 7A shows a case in which the ink without resin 72 lands on a recording medium 71, and then the ink with resin 73 lands thereon. In the ink without resin 72 landing on the recording medium 71 first, pigment particles remain on the recording medium 71 while liquid, such as water and a solvent, permeate into the recording medium 71. When a dot of the ink with resin 73 lands on the ink without resin 72, water and a solvent of the ink with resin 73 penetrate through the pigment particles of the ink without resin 72 landing first, and the water and the solvent permeate into the recording medium 71. Only a small difference is present between a permeant speed in a region where the water and solvent directly permeate into the recording medium and a permeant speed in a region where the water and solvent penetrate through the former-landing dot and then permeates into the recording medium. Referring to FIG. 7A, the ink with resin 73 naturally overlaps with the ink without resin 72.

FIG. 7B illustrates a case in which a dot of the ink with resin 73 lands on the recording medium 71 first. In the ink with resin 73 landing on the recording medium 71 first, water and a solvent permeate into the recording medium 71, and pigment particles remain on the recording medium 71, in a similar manner to FIG. 7A. However, referring to FIG. 7B, a behavior of the later-landing ink without resin 72 is different. In particular, the later-landing dot 72 laterally shifts and does not remain on the dot 73. This is because a large difference is present between a permeant speed in a region where the water and solvent directly permeate into the recording medium and a permeant speed in a region where the water and solvent penetrate through the former-landing dot and then permeate into the recording medium. That is, since a resin component of the former-landing dot 73 interrupts the water and solvent of the later-landing ink from permeating into the recording medium, the water and solvent may permeate in a region not occupied by the dot 73 (blank region of recording medium), and the pigment particles also move to the region not occupied by the dot 73. The phenomenon as shown in FIG. 7B may occur when an former-landing ink has resin added regardless of whether a later-landing ink contains resin. In this embodiment, the resin is added to the ink in a later process. However, it is found that the phenomenon occurs even when resin is used for dispersing a pigment, as the amount of the resin increases.

As described above, the water and solvent of the later-landing ink are interrupted from permeating into the recording medium by the resin component of the former-landing ink. Thus, the later-landing pigment ink moves to the region without a dot recorded, that is, to the recording medium, and forms a dot. At this time, since the region into which the water and solvent to permeate is a smaller region than a normal dot diameter, the pigment particles may be concentrated, and hence, a dot with a higher density than a normal density is formed in a smaller dot area than a normal dot area. If the dot with the higher density than the normal density is present in a recording surface, an image characteristic (in particular, graininess) of a recorded object may be degraded.

The interest of invention is directed to a phenomenon in which, when a dot of the ink without resin (first ink) overlaps with a dot of the ink with resin (second ink), a difference is present between a remaining state of a former-landing ink and that of a later-landing ink depending on which ink lands first. That is, density unevenness is reduced by controlling the landing order of the two inks.

Figure 8:
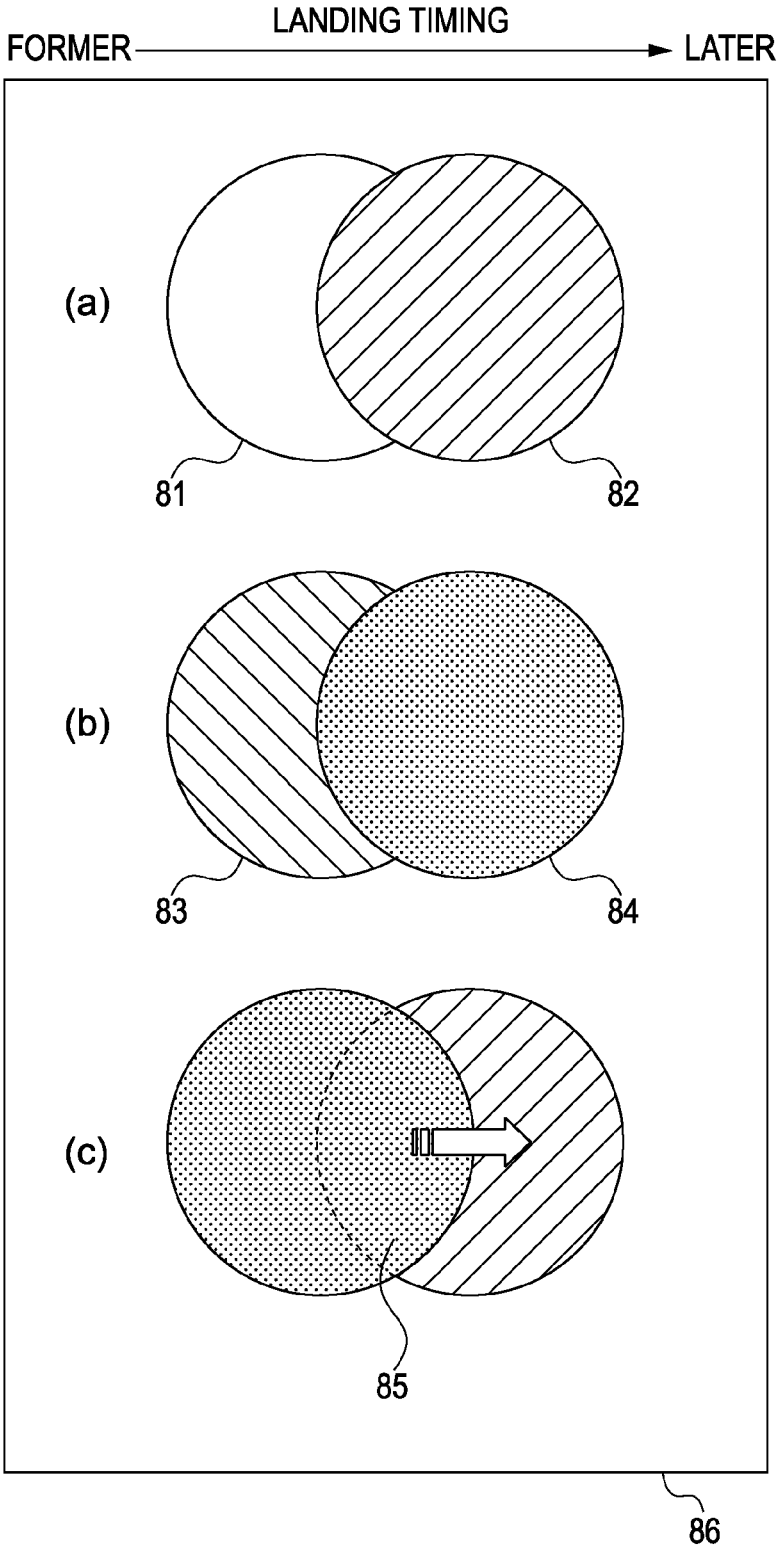
FIG. 8 is a schematic illustration showing a difference of an ink-remaining likelihood when inks overlap with each other.

Now, a difference between "remaining states" will be described. FIG. 8 illustrates after-landing states when two dots are recorded on a recording medium at different discharge timings. In each of parts (a) to (c) of FIG. 8, a left dot is a former-landing ink, and a right dot is a later-landing ink. As a landing-position relationship between the two dots, while description is based on a relationship in which a half of a dot diameter of a dot overlaps with that of another dot, any relationship is applicable as long as a dot of a later-landing ink contacts both a dot of a former-landing ink and a recording medium. A shift time for shifting landing timings from one another may be a very short time difference such as that dots record with the same path. However, if a shift time is several seconds, movement of a dot may become apparent and the remaining state can be easily determined.

Part (a) of FIG. 8 illustrates a result of two types of inks without resin 81 and 82 partly overlapping with each other on a recording medium 86. In this case, an ink of a left dot lands on a recording medium, and then an ink of a right dot lands thereon. Hence, the right dot overlaps with a right half of the left dot.

Next, part (b) of FIG. 8 illustrates a result that a dot of an ink with resin 84 lands on a dot of an ink without resin 83. Similarly to part (a) of FIG. 8, the later-landing dot of the ink with resin 84 remains on the ink without resin 83. In contrast, part (c) of FIG. 8 illustrates a result that a dot of an ink with resin 84 lands and then an ink without resin 82 lands thereon in a reversed manner to part (b) of FIG. 8. In this case, a behavior different from a normal behavior appears. The area of the dot of the former-landing ink, which is covered with the dot of the later-landing ink in part (a) of FIG. 8, is not covered with the ink without resin 82 in part (c) of FIG. 8. The ink without resin 82 moves in a direction indicated by an arrow in FIG. 8. Thus, when an ink with resin and an ink without resin land in an overlapped manner, a rate of the later-landing ink remaining on the former-landing ink may vary depending on the type of former-landing ink. Hereinafter, an ink with a relatively large rate of the later-landing ink remaining on the former-landing ink is referred to as an easily-remaining ink (ink having high ink-remaining likelihood). Also, an ink with a relatively small rate of the later-landing ink remaining on the former-landing ink is referred to as a hardly-remaining ink (ink having low ink-remaining likelihood). That is, in this embodiment, the ink with resin is the easily-remaining ink, and the ink without resin is the hardly-remaining ink.

Another approach for defining the ink without resin and the ink with resin may be an overlapping rate after a predetermined time elapses since two dots overlap with each other, instead of the likelihood of remaining. The overlapping rate is of a remaining area of the dot of the later-landing ink remaining on the former-landing ink to an area of the dot of the former-landing ink. That is, the easily-remaining ink (ink with resin) has a high overlapping rate. In contrast, the hardly-remaining ink (ink without resin) has a low overlapping rate.

For example, an optical microscope may be used to observe the positions of the overlapping dots of the two types of inks. Accordingly, the level of the ink-remaining likelihood of the later-landing ink can be determined. While FIGS. 7A, 7B, and 8 show a case in which the ink does not remain on the ink with resin, the level of the ink-remaining likelihood may be determined even when a certain amount of the ink remains on the ink with resin.

The level of the ink-remaining likelihood may be determined by a colorimetric value of a secondary color of two inks for comparison. For example, a secondary color image, in which a 100% solid image is recorded with the hardly-remaining ink and then the easily-remaining ink is recorded, is compared with a secondary color image recorded in a reversed recording order. In the image in which the easily-remaining ink is recorded first, a dot of the former-recorded ink is covered with a dot of the later-recorded ink. The color of the solid image is the sum of the two dots. In contrast, in the image in which the hardly-remaining ink is recorded first, the upper dot moves away and the color of the lower dot likely appears. Hence, the color of the solid image is closer to the color of the lower dot, as compared with the image in which the easily-remaining ink is recorded first. Thusly, the level of the ink-remaining likelihood can be determined by comparing with each other the colors of the solid images of the two inks with the different levels of the ink-remaining likelihood.

In this embodiment, while the level of the ink-remaining likelihood is determined on the basis of the overlapping state of the two dots by changing the landing order of the two dots, it is not limited thereto. The level of the ink-remaining likelihood can be determined on the basis of a shift when a common ink lands on the ink with resin and on the ink without resin.

In this embodiment, the cyan ink is the easily-remaining ink (ink with resin), and other inks are the hardly-remaining inks (inks without resin).

In light of this, the landing order when the dot discharge positions of the ink with resin and the ink without resin overlap with each other is controlled, so as to reduce density unevenness of dots of a secondary color containing the ink with resin. More specifically, regarding the ink with resin and the ink without resin overlapping with each other in the same pixel, the density unevenness is reduced by allowing the ink without resin to land first.

A record control procedure of this embodiment will be described below with reference to FIG. 9. In the record control procedure in FIG. 9, featured processing of this embodiment is provided in addition to the procedure with the record control unit 305, which has been described with reference to FIG. 4. The featured processing is for controlling the landing order such that the ink with resin can land on the ink without resin when the ink with resin and the ink without resin are recorded in an overlapping manner. More specifically, a mask pattern of a nozzle array from which the ink with resin is discharged is changed for a predetermined region so that the ink with resin can be discharged in a path after a path of the ink without resin. Assuming that a predetermined region defines a unit pixel, a mask pattern is changed for every unit pixel. The mask pattern, however, may be changed every path or for every given region including a plurality of unit pixels.

As described above, the record control unit 305 converts the input data 401 input from the image input unit 302 into the multivalued CMYK data 402, and then the binarization processing 403 is performed, thereby generating the binarized output image data 404. In this embodiment, in parallel to this processing, a mask selection parameter calculation 902 is performed for the CMYK data 402, and hence a mask selection parameter (MP) 903, which is a one-dimensional parameter, is obtained. The mask selection parameter (MP) 903 determines a mask pattern of a nozzle array from which the ink with resin (cyan ink) is discharged, for every predetermined region.

Figure 10:
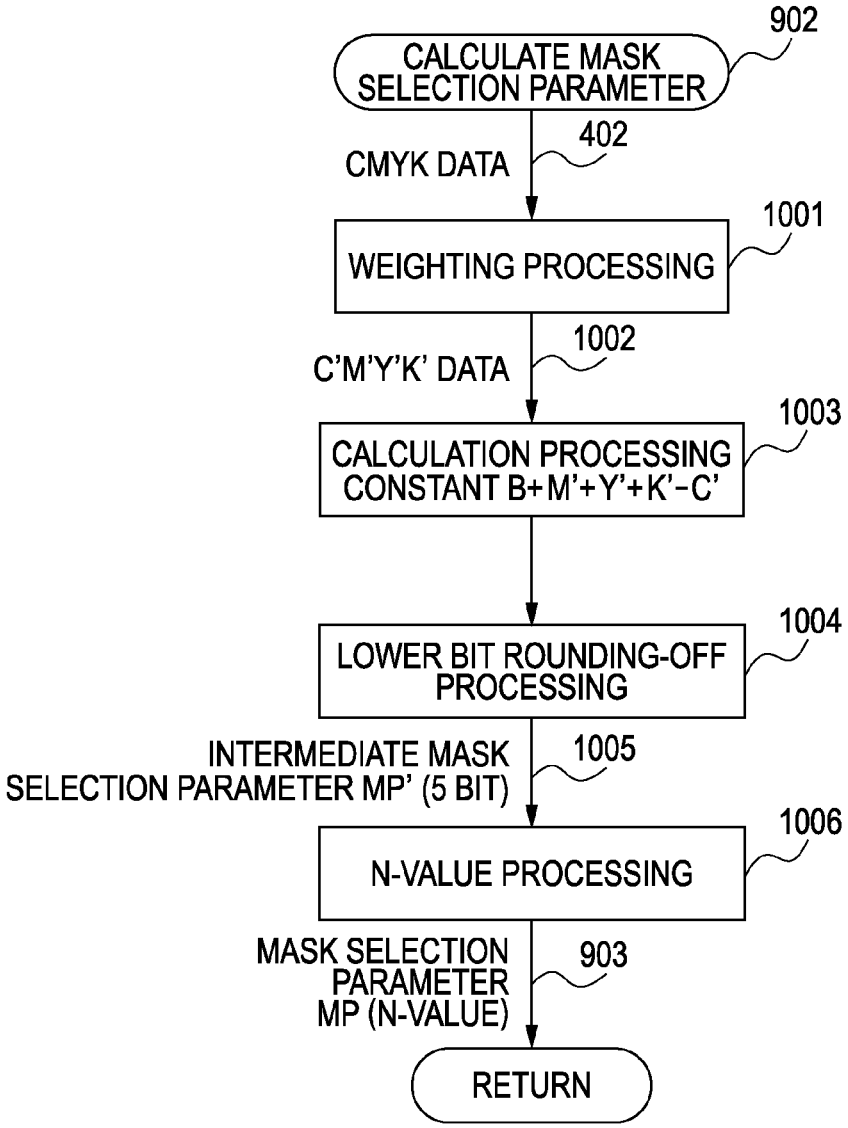
FIG. 10 is a flowchart showing a procedure of mask selection processing according to the first embodiment.

FIG. 10 illustrates a sequence of the mask selection parameter calculation 902. First, weighting processing 1001 is applied to the input CMYK data 402 of each color. In the weighting processing 1001, a weighting coefficient (value from 0 to 1) is determined, and a data value (gradation value) of CMYK data is multiplied by the weighting coefficient. The weighting coefficient represents an influence on mask selection for each ink, and is desirably determined. Data with a larger weighting coefficient causes mask selection with a smaller data value (ink application amount per unit pixel). When the CMYK data 402 are multiplied by the respective weighting coefficients, C'M'Y'K' data 1002 is obtained. The CMYK data 402 and the C'M'Y'K' data 1002 are both 8-bit data. After the weighting processing 1001, a fraction is rounded off to obtain an integer.

Next, in calculation processing 1003, the sum of the M' data, Y' data, and K' data of the inks without resin is used to calculate a difference between the sum and the C' data of the ink with resin. Then, a constant B is added to the calculated result. With the calculation, when the ink application amount of the ink with resin (C) increases as compared with the ink application amount of the inks without resin (MYK) in a unit pixel, the mask pattern becomes no longer changed. The constant B is added in order to avoid an intermediate mask selection parameter (MP') 1005 from becoming a negative number.

Lower bit rounding-off processing 1004 is applied to the calculation result data to obtain data of 5-bit (32 values), which is an intermediate mask selection parameter (MP') 1005. With the calculation, the intermediate mask selection parameter (MP') 1005 becomes a value corresponding to the relationship between the ink discharging amount of the ink with resin and the ink discharging amount of the ink without resin. For example, when the ink application amount of the ink with resin is small and the ink application amount of the ink without resin is large, the intermediate mask selection parameter (MP') 1005 becomes a large value. In contrast, when the ink application amount of the ink with resin is large and the ink application amount of the ink without resin is small, the intermediate mask selection parameter (MP') 1005 becomes a small value.

Further, N-value processing 1006 is applied to the intermediate mask selection parameter (MP') 1005, so that the intermediate mask selection parameter (MP') is converted into a N-value mask selection parameter (MP) 903. The N-value method may rely upon ordinary error diffusion or dither matrix. In this embodiment, error diffusion is used. Using the error diffusion, the mask pattern can be changed for a unit pixel which is adjacent to a unit pixel whose mask pattern is changed. Continuity of the mask patterns to be used is improved. Thus, the value N corresponds to the number of types of mask patterns to be changed. In this embodiment, The value N is 2 because two types of mask patterns are used. That is, the mask selection parameter (MP) 903 involves two types of "0" and "1". The number of types of mask patterns to be selected may be increased by increasing the value N from 2. Hence, the number of mask patterns to be changed is not limited to the number provided in this embodiment.

FIG. 11 is conversion examples for a range of from the CMYK data 402 to the intermediate mask selection parameter (MP') 1005. Here, an example of performing the calculation processing 1003 in which, when the cyan (C) ink is used as the ink with resin and the magenta (M) ink is used as the ink without resin to record a secondary color, the constant B is added to the difference between the M' data and the C' data after the weighting processing. Referring to FIG. 11, when the application amount of the cyan ink is larger than the application amount of the magenta ink, the intermediate mask selection parameter (MP') 1005 becomes a smaller value. When the application amount of the cyan ink is smaller, the intermediate mask selection parameter (MP') 1005 becomes a large value.

As described above, the image processing is performed, in which the input data 401 is converted into the binarized output image data 404. Then, the mask selection parameter (MP) 903 is obtained for every unit pixel on the basis of information (gradation values of CYMK data) corresponding to the application amount of the cyan ink per unit pixel and the application amount of the magenta ink per unit pixel. The mask selection parameter (MP) 903 is used for selection of the mask pattern to be used for every unit pixel of the binarized output image data 404.

FIG. 12 shows the relationship between a value of the mask selection parameter (MP) 903 and a mask pattern. The cyan ink which is the ink with resin uses a normal mask or a later-recording mask depending on the value of the mask selection parameter (MP) 903. The magenta ink, which is the ink without resin, only uses the normal mask.

Figure 6A:
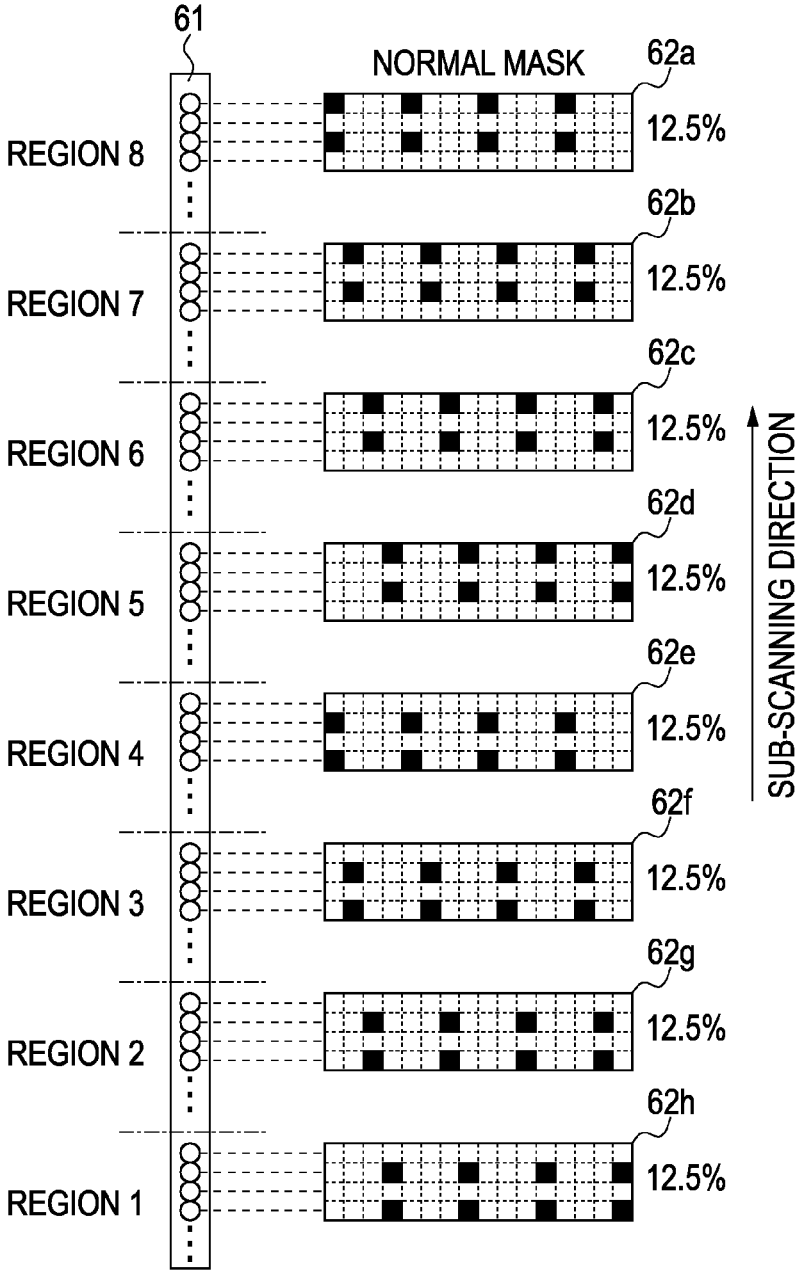
FIGS. 6A and 6B are schematic illustrations each showing a mask pattern to be used when multipath recording with 8 paths is performed according to a first embodiment.
Figure 6B:
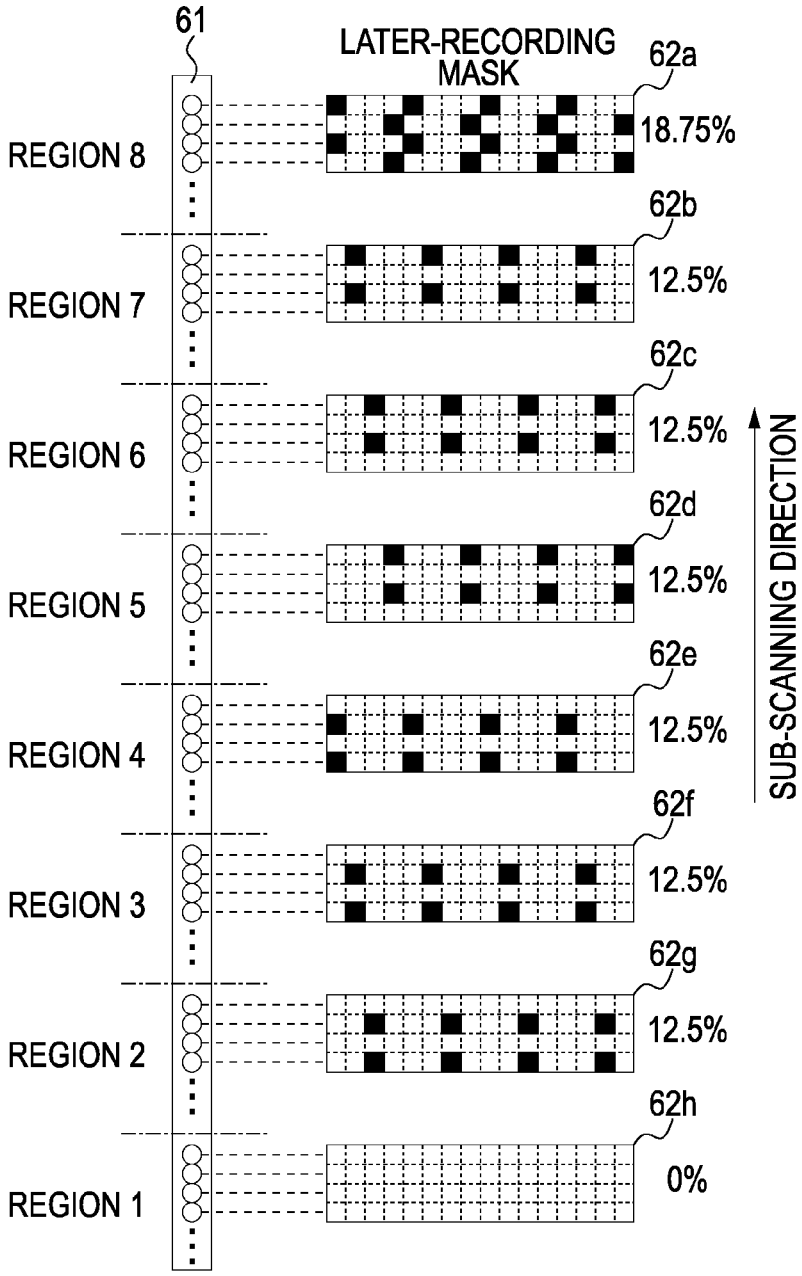

FIG. 6A is a schematic illustration showing a mask pattern for multipath recording with 8 paths used in this embodiment. A nozzle array 61 represents a single-color nozzle array on the recording head 21, and has 1280 nozzles arranged in the sub-scanning direction at a pitch of 1200 dpi. When 8-path recording is performed, the plurality of nozzles are divided into 8 regions respectively used for scanning operations. The 8 regions form an image in a combined manner. Mask patterns 62*a* to 62*h* respectively applied to the regions are shown at the right side of FIG. 6A. A single rectangle of each mask pattern represents a single pixel. Black regions represent dot-recording-permitted pixels and white regions represent dot-recording-inhibited pixels. The mask patterns 62*a* to 62*h* of this embodiment each have an equivalent recording permissibility of 12.5%, and are complemented with each other. Hereinafter, such a mask is called normal mask. In FIGS. 6A and 6B, a mask pattern has 16 pixels in the main-scanning direction and 4 pixels in the sub-scanning direction for easier understanding. However, an actual mask pattern has 160 pixels in the sub-scanning direction to correspond to a region for a single path, and a further wide range in the main-scanning direction. In this embodiment, a mask pattern with high regularity is used. However, a mask pattern with high disorder property (dispersant property) may be used. In this embodiment, the mask pattern in FIG. 6A serves as an 8-path mask pattern (normal mask) for the ink without resin.

A mask pattern in FIG. 6B is an 8-path mask pattern (later-recording mask) to delay landing of the ink with resin with respect to the resin without ink. The mask pattern is different from the normal mask whose recording permissibility of each region is equivalent. A region 1 has a recording permissibility of 0, and a region 8 has a recording permissibility of 18.75%. The recording permissibility is merely an example, and may be any value as long as the number of dots is increased in a later-half region by increasing the permissibility in the later-half region, in comparison with the normal mask. By using the later-recording mask and the normal mask, the landing order in the secondary color can be controlled. For example, the later-recording mask may be used for the cyan ink (ink with resin), and the normal mask may be used for the magenta ink (ink without resin). Thus, comparing with the case in which the normal mask is applied to all inks, the cyan ink is more likely arranged on the magenta ink.

Figure 9:
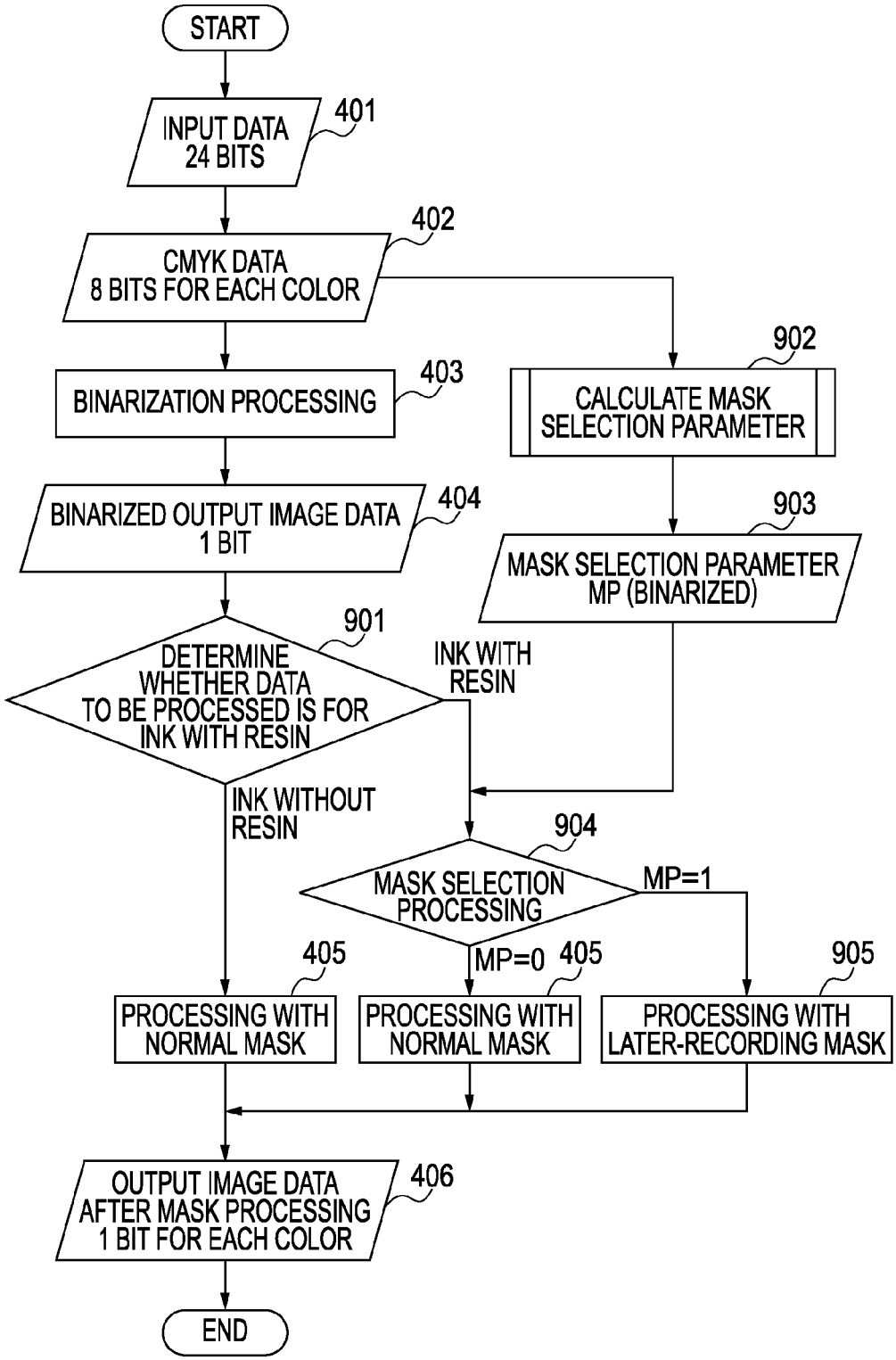
FIG. 9 is a flowchart showing a procedure of image processing according to the first embodiment.
Figure 13:
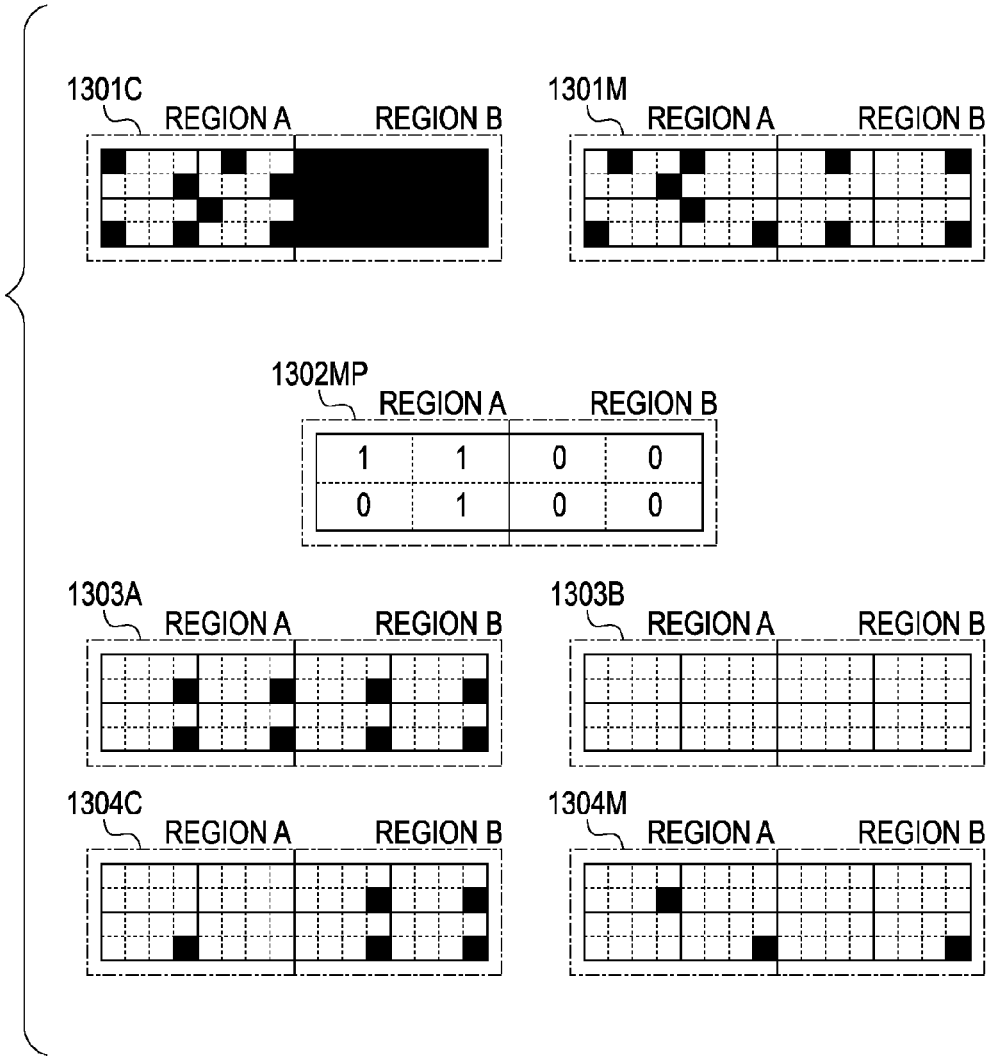
FIG. 13 illustrates an example of image data for describing the image processing according to the first embodiment.

In this embodiment, when the ink with resin and the ink without resin overlap with each other in the same pixel, the recording order of the ink with resin and the ink without resin is controlled so that the ink without resin In particular, in step 901 in FIG. 9, it is can land first. In particular, in step 901 in FIG. 9, it is determined whether or not recording data relates to the ink with resin or the ink without resin. If the recording data is for the ink without resin, processing 405 is performed to divide the recording data into recoding regions with the normal mask. In contrast, if the recording data relates to the ink with resin, it is determined whether the normal mask or the later-recording mask is used on the basis of the mask selection parameter (MP) 903 (step 904). If it is determined that the normal mask is used, the processing 405 is performed to divide the recording data into recording regions with the normal mask. If it is determined that the later-recording mask is used, processing 905 is performed to divide the recording data into the recording regions with the later-recording mask. The normal mask and the later-recording mask shown in FIGS. 6A and 6B are selectively used for the ink with resin in every unit pixel. A logical product of the binarized output image data 404 and the selected mask pattern is obtained, thereby recording an image. FIG. 13 illustrates examples of the binarized output image data 404, the mask selection parameter (MP) 903, and a mask pattern to be used, as well as a recording method therewith. Reference characters 1301C and 1301M represent binarized output image data of cyan data and magenta data. An image to be actually recorded is an image in which the two images overlap with each other. Here, for easier understanding, a left half region of the binarized output image data is called region A, and a right half region is called region B.

Reference character 1302 MP represents the mask selection parameter (MP) 903 obtained by the mask selection parameter calculation. As described above, since the mask selection parameter (MP) 903 is generated per unit pixel, a value is defined for 8 recording pixels. In FIG. 13, the region A mainly contains pixels with relatively small application amount of the cyan ink. 75% of the mask selection parameter (MP) 903 in this region corresponds to 1, and hence, the later-recording mask is selected. Herein, the mask selection parameter (MP) 903 varies although the gradation value (data value) is equivalent because error diffusion is used for binarization. In contrast, the region B mainly contains pixels with relatively large application amount of the cyan ink. All mask selection parameters (MP) 903 are 0.

Reference characters 1303A and 1303B illustrate parts of the normal mask and the later-recording mask. Here, a mask pattern of the region 1 in FIGS. 6A and 6B is described as an example. In this region, the normal mask has a uniform recording permissibility of 12.5%. The later-recording mask has a recording permissibility of 0. Logical products of the mask patterns selected on the basis of the mask selection parameter (MP) 903 and the output image data 1301C and 1301M are obtained. Hence, after-mask-processing output image data 1304C and 1304M are determined. By applying the processing to each of the regions of the nozzle array, recording pixels per recording scanning operation (path) are determined, and recording data per recording scanning operation is generated. By discharging ink in accordance with the generated recording data, an image is completed.

As described above, by using the mask selection parameter (MP) 903 obtained from the CMYK data 402, the mask patterns can be selectively changed for each unit pixel so that the ink with resin is arranged at an upper position. Accordingly, the interruption of the later-recorded ink from permeating into the recording medium when the former-recorded ink is arranged on the ink with resin is reduced, and degradation of image quality due to density unevenness can be reduced. By allowing the ink without resin to land first on at least one of unit pixels, the landing order, which may cause unevenness, can be controlled for the unit pixel. In particular, ink without resin may land first in more than half of all unit pixels.

To check the effect of the processing in this embodiment, density unevenness of secondary color images of the cyan (ink with resin) and the magenta (ink without resin) was evaluated. FIG. 14 shows the evaluation result. Herein, a recording medium used photo glossy paper (Product name, "Photo Glossy Paper (thin type) LFM-GP421R") manufactured by CANON KABUSHIKI KAISHA, and a recording operation used multipath recording with 8 paths.

FIG. 14 shows density unevenness in an image in this embodiment and that in related art in which only a normal mask or a later-recording mask is used. Unevenness (resin) shown in FIG. 14 is image unevenness generated when the ink with resin and the ink without resin land on the same pixel, as described above. Also, unevenness (overflow) is generated due to recording with a particularly irregular mask. The factor of the unevenness (overflow) is different from that of the density unevenness caused by using the ink with resin and the ink without resin. That is, the unevenness (overflow) is generated because, when a recording duty is high, the discharged ink does not permeate into a recording medium but overflows, and is recorded at a position shifted from an expected recording position.

In this embodiment, a normal mask is used in example 3 in which the discharging amount of the cyan ink is larger than the discharging amount of the magenta ink. Hence, the unevenness (overflow) can be reduced. That is, when the amount of the magenta ink (ink without resin) is small like example 3, the unevenness (resin) is only slightly reduced by using the later-recording mask. Thus, priority is given to reduction in the unevenness (overflow) by using the later-recording mask. In data example 1 and data example 2 in which the discharging amount of the cyan ink is small, the unevenness (resin) can be reduced by using the later-recording mask. It is to be noted that only the normal mask is applied to a region where the cyan ink is not used, and normal recording is performed.

The mask selection parameter (MP) 903 can be obtained even by directly binarizing the calculated value of the calculation processing 1003. In this embodiment, the calculated value of the calculation processing 1003 is converted into the intermediate mask selection parameter (MP') 1005, and then is binarized. If the calculated value of the calculation processing 1003 is directly binarized, variation in mask selection parameters (MP) 903 becomes noticeable between adjacent unit pixels because of the characteristic of error diffusion. Hence, a lower bit of the calculated value is rounded off so as to decrease a variation of the mask selection parameter (MP)

903. Accordingly, the mask change can be continuously carried out for each unit pixel, and image degradation generated because the mask patterns to be used differ from each other between the adjacent pixels can be prevented.

In this embodiment, while the intermediate mask selection parameter (MP') 1005 is obtained through the calculation, similar processing may be carried out by referring to a lookup table. In short, a combination of CMYK data 402 and a mask pattern may be determined in advance.

With this embodiment, when an image is recorded with the ink with resin and the ink without resin, the density unevenness can be reduced in the region where the ink with resin and the ink without resin overlap with each other, by controlling the application order of the inks. This is because the interruption of permeation of the later-landing ink into the recording medium, as a result of the dot of the ink with resin being present on the recording medium, is reduced. Further, since the ink with resin is located at an upper position of a recording surface, scratch resistance can be increased.

Figure 17:
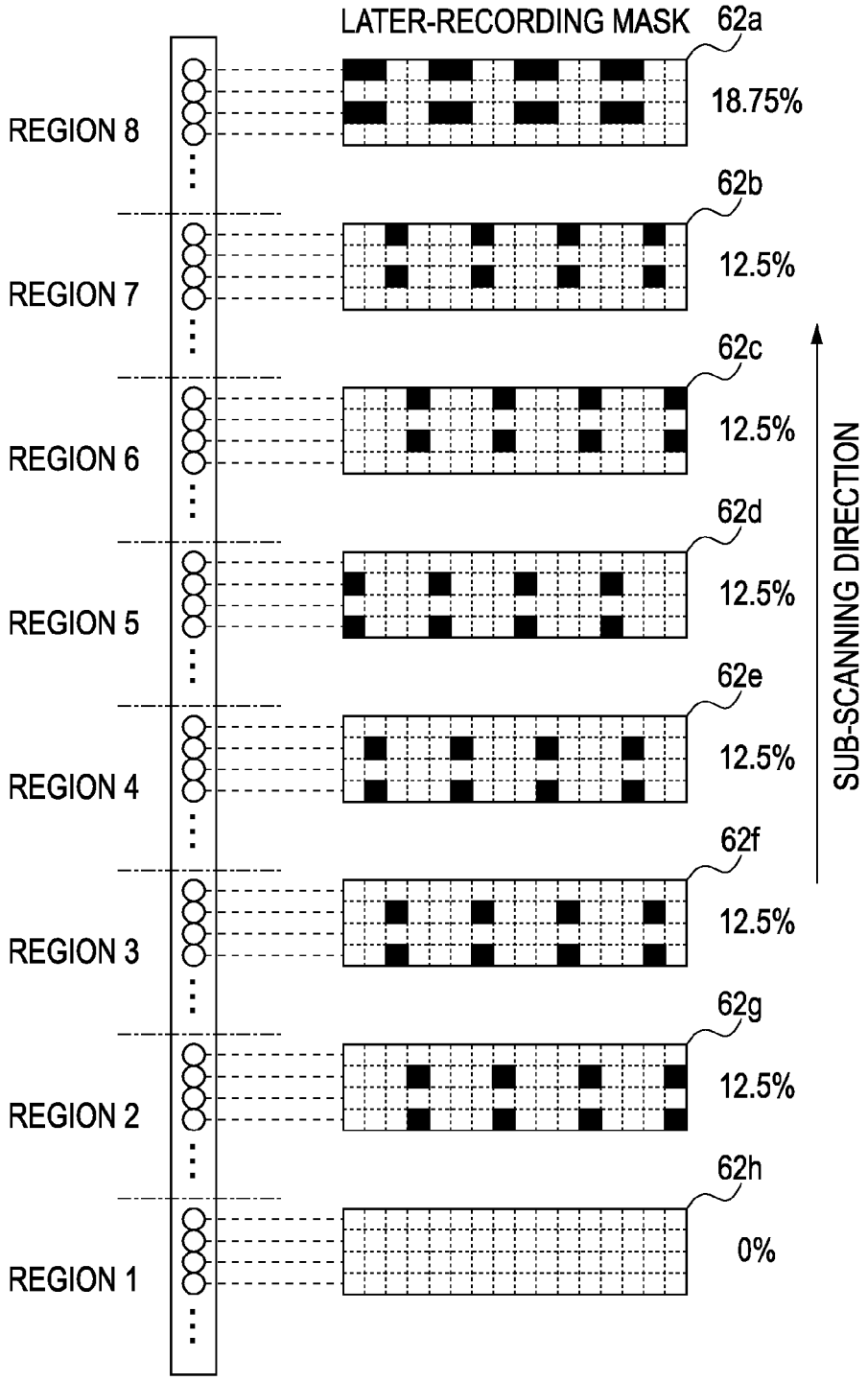
FIG. 17 is a schematic illustration showing another example of a mask pattern for multipath recording with 8 paths used for a nozzle array for an ink with resin according to the first embodiment.

Further, in the above description, the ink (magenta) can land first by increasing the recording permissibility of the mask pattern applied to the ink with resin (cyan) for the later half of the plurality of scanning operations, as compared with the recording permissibility of the mask pattern for the former half. However, the mask pattern applied to the ink with resin (cyan) is not limited to the above-mentioned mask pattern. For example, referring to FIG. 17, recording-permitted pixels defined by the normal mask shown in FIG. 6A may be arranged in a later path than that of the normal mask. In a later-recording mask in FIG. 17, recording-permitted pixels defined at a first path (region 1) of the normal mask are defined at a second path (region 2) of the later-recording mask, and recording-permitted pixels defined at a second path (region 2) of the normal mask are defined at a third path (region 3) of the later-recording mask. With such a later-recording mask, the ink without resin can land first on the pixel where the ink with resin and the ink without resin overlap with each other. Accordingly, the density unevenness can be reduced. Further, the later-recording mask in FIG. 17 may be configured such that a recording permissibility of the later half of a plurality of scanning operations is increased as compared with a recording permissibility of the former half.

In this embodiment, the mask pattern is selectively changed so that the later-recording mask is used only at a position where the unevenness (resin) has to be reduced. With this method, the mask pattern is effectively changed, and the unevenness (resin) and unevenness (overflow) can be reduced. Also, at a position where the mask pattern does not have to be changed, the normal mask can be used to form an image with a uniform density, and the nozzles to be used can be equalized. Typically, the recording head may be deteriorated when discharging with a nozzle is repeated a predetermined number of times or more. Thus, with the above control, the life of the recording head can be increased.

Various embodiments may be employed within the technical idea of the invention in which the landing order of the ink with resin and the ink without resin is controlled such that the ink with resin can land on the ink without resin as described above.

Second Embodiment

A second embodiment differs from the first embodiment in that a mask pattern used for both the ink with resin and the ink without resin is selected, while the mask pattern only for the ink with resin is selected in the first embodiment.

Figure 15:
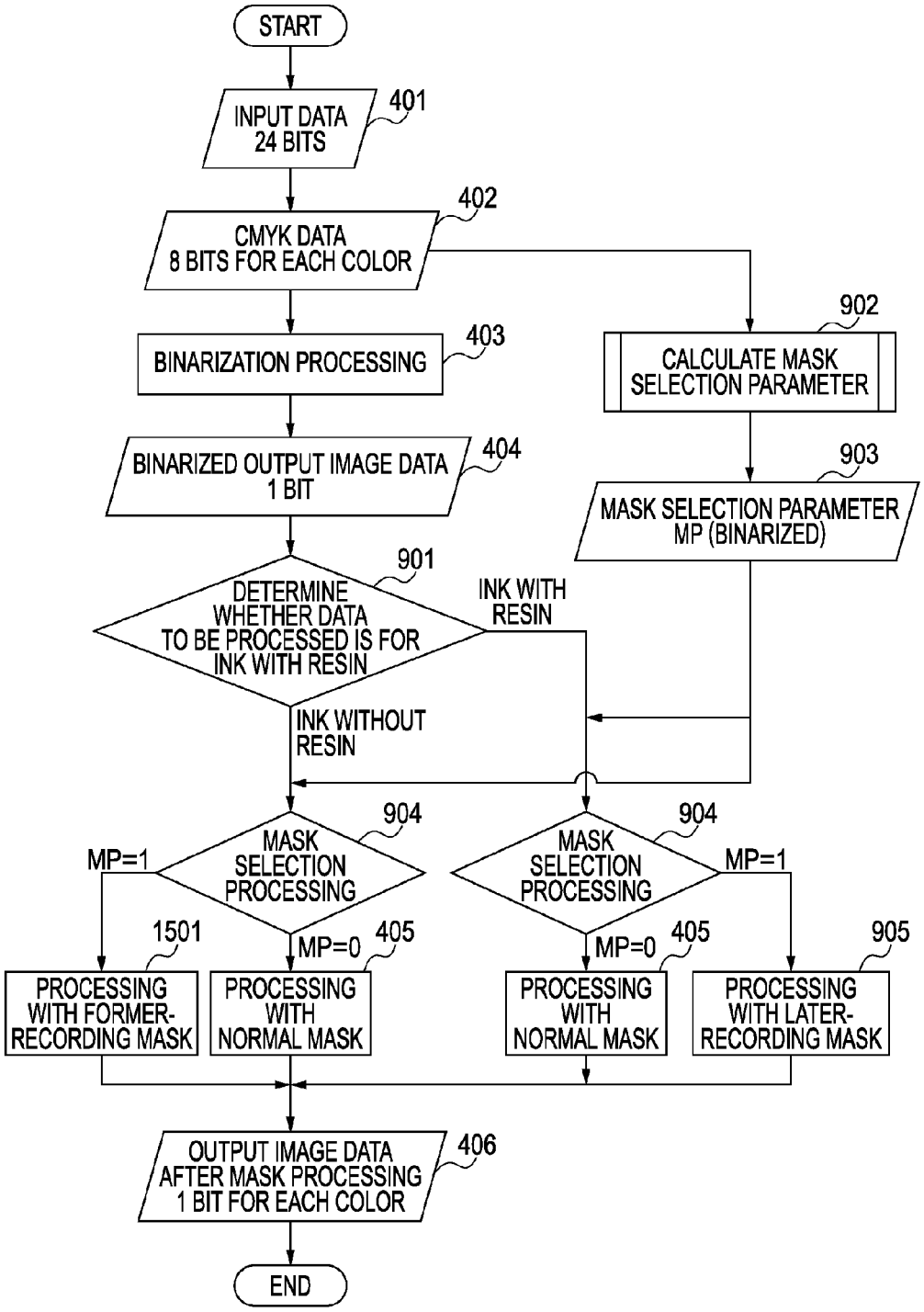
FIG. 15 is a flowchart showing the image processing according to the first embodiment.

FIG. 15 is a flowchart of image data processing (record control procedure) of this embodiment. Similarly to the first embodiment, the CMYK data 402 is obtained from the input data 401 through the above-described image processing. Then, in the binarization processing 403, the CMYK data 402 is converted into the binarized output image data 404 for determining recording or non-recording of a recordable dot by the recording apparatus. Further, the mask selection parameter calculation 902 is performed to generate the mask selection parameter (MP) 903 on the basis of the CMYK data 402. In this embodiment, similarly to the first embodiment, the mask selection parameter (MP) 903 is determined through N-value processing (binarization processing) 1006 of the intermediate mask selection parameter (MP') 1005. Using the binarized mask selection parameter (MP) 903, mask patterns are selected for the ink with resin and the ink without resin. This embodiment differs from the first embodiment in that, if it is determined that the recording data is for the ink without resin in step 901, processing 1501 can be performed to use the former-recording mask in accordance with the mask selection parameter (MP) 903.

Figure 18:
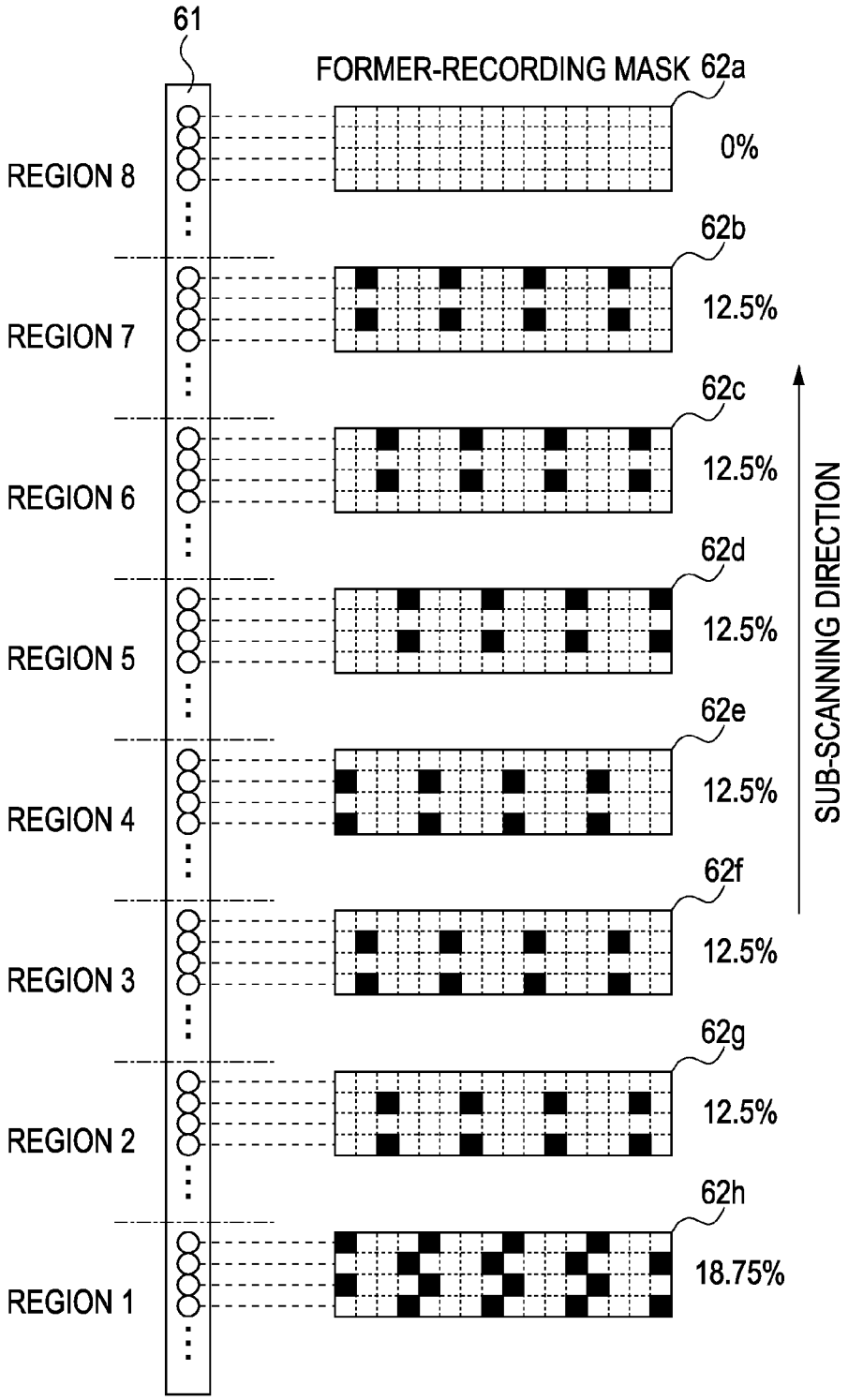
FIG. 18 is a schematic illustration showing a mask pattern for multipath recording with 8 paths used for a nozzle array for ink without resin according to a second embodiment.

FIG. 16 illustrates a combination of a mask selection parameter (MP) 903 and a mask pattern to be used. Referring to FIG. 16, the mask pattern for the ink without resin is a former-recording mask shown in FIG. 18 in addition to the normal mask. The former-recording mask is a mask pattern whose recording permissibility of the former half of a plurality of scanning operations is increased in a manner opposite to the later-recording mask (FIG. 6B). A recording rate in a region 8 is 0, and a recording rate in a region 1 is 18.75%. The three types of mask patterns are selectively used on the basis of the mask selection parameter (MP) 903.

In particular, in a unit pixel where the normal mask is used for the ink with resin, the normal mask is also used for the ink without resin. In contrast, in a unit pixel where the later-forming mask is used for the ink with resin, the former-recording mask is used for the ink without resin. That is, by using the former-recording mask for the ink without resin when the later-recording mask is used for the ink with resin, the ink with resin can be recorded in a recording scanning operation after a normal recording scanning operation, and the ink without resin can be recorded in the former half of the recording scanning operations. As described above, by changing the mask pattern for not only the ink with resin, but also the ink without resin, the ink with resin can land on the ink without resin with a higher possibility than that of the first embodiment. The density unevenness can be further reliably reduced.

With this embodiment, the mask patterns for both the ink with resin and the ink without resin are selected and the application order is controlled for a region where both the ink with resin and the ink without resin are discharged. Accordingly, the density unevenness can be further efficiently reduced. Since the former-recording mask is used for the ink without resin and the later-recording mask is used for the ink with resin, the ink with resin can land on the ink without resin with a high possibility.

It is to be noted that the combination of the ink with resin and the ink without resin is not limited to the cyan ink and another color ink (MYK) of the first embodiment. For example, description will be based on pigment inks sorted into an ink with resin and an ink without resin.

Modifications

In the above-described embodiments, the later-recording mask and the former-recording mask are used so that the dot of the ink with resin lands on the dot of the ink without resin when dots of the ink without resin and the ink with resin overlap with each other. The above control may be performed without a mask pattern.

For example, a position of a pixel in which the ink without resin and the ink with resin overlap with each other and the landing order are detected by using output image data 411 developed by the normal mask in FIG. 6A. Then, in a pixel, in which the ink with resin is expected to be arranged below the ink without resin, image data for the ink with resin may be converted such that the ink with resin is discharged in a scanning operation after a scanning operation for discharging the ink without resin. With the processing, a mask pattern does not have to be prepared in the ROM 307, thereby reducing the cost of parts.

In the later-recording mask shown in FIG. 6B, the later-recording mask of one type is used, in which only the recording region 1 has the recording permissibility of 0%. However, the regions 1 and 2 may have the recording permissibility of 0%. The number of such regions is not particularly limited. Also, with the later-recording mask shown in FIG. 6B, the recording permissibility of a region to be recorded with a former half path such as the recording region 1 may be smaller than that of a region to be recorded with a later half path such as the recording regions 5 to 8, so as to control the landing order such that the ink with resin can be arranged at the upper position. Thus, the recording permissibility of the recording region 1 is not necessarily 0. Similarly, the recording permissibilities of regions of mask patterns serving as the normal mask and the former-recording mask are not particularly limited.

In addition, the rates may be changed depending on the type of recording mode (draft mode or high-resolution mode) or the type of recording medium (type of ink receiving layer such as a highly absorptive receiving layer, use type of such as glossy paper or matt paper). Also, a predetermined region the mask pattern is changed for may be a region corresponding to a dot formed with ink on a recording medium, and other various types of regions.

Also, in the above-described embodiments, the binarized output image data is divided to obtain recording data for every recording scanning operation, while the data may be divided for every recording scanning by using a mask pattern for the multivalued CMYK data.

In this embodiment, materials are exemplified to increase fastness (in particular, scratch resistance). However, the ink with resin applicable to the invention is not limited to the ink aimed at the fastness. Without limiting to the fastness, ink with resin may aim at increase in any performance of a pigment-ink image, for example, image quality like gloss uniformity, metamelism, or bronzing.

Also, in the above-described embodiments, one color of the pigment ink is used as a color ink with resin. a plurality of inks with different densities, or a plurality of inks with different phases may be used. Also, other than the pigment ink, resin which is a material to increase the image performance (in the above-described embodiment, fastness) may be added to colorless and clear processing liquid or the like. By applying this configuration to the above-described embodiments, an advantage of reducing the density unevenness can be provided. Also, the ink applicable to the invention is featured that the ink-remaining likelihood of the later-landing ink is different. The ink composition is not limited to the above-described ink composition.

The present invention can be applied to recording apparatuses which use a recording medium, such as paper, cloth, unwoven cloth, or OHP film. In particular, an apparatus to be applied may be a business machine, such as a printer, a copier, or a facsimile, or a mass production machine. In the above-described embodiments, the record control unit 305 for the featured processing of the invention is provided in the inkjet recording apparatus, however, the record control unit 305 does not have to be provided in the inkjet recording apparatus. For example, a printer driver of the host computer (image input unit 302) connected to the inkjet recording apparatus may have the function of the record control unit 305. In this case, the printer driver generates the binarized output image data 404 and the mask selection parameter (MP) 903 on the basis of the multivalued input data 401 received from an application. The generated data is supplied to the recording apparatus. As described above, an inkjet recording system including the host computer and the inkjet recording apparatus may be within the scope of the invention. In this case, the host computer functions as a data supply device that supplies data to the inkjet recording apparatus, and may function as a control device that controls the inkjet recording apparatus.

Also, a data generating device including the record control unit 305 that performs the featured data processing of the invention may be within the scope of the invention. When the record control unit 305 is provided in the inkjet recording apparatus, the inkjet recording apparatus functions as the data generating device. When the record control unit 305 is provided at the host computer, the host computer functions as the data generating device of the invention. Further, a computer program configured to cause a computer to execute the featured data processing and a recording medium storing the program in a manner readable by the computer are within the scope of the invention.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-160772 filed Jun. 19, 2008, which is hereby incorporated by reference herein in its entirety.

What is claimed is:

1. An inkjet recording apparatus, comprising:

a recording unit configured to cause an inkjet head to discharge a first ink and a second ink to a unit area of a print medium, wherein the second ink has an ink-remaining likelihood on the first ink higher than an ink-remaining likelihood of the first ink on the second ink;

a scanning unit configured to cause the inkjet head to perform a plurality of scans on the unit area of the print medium for discharging the first and second inks thereon;

an obtaining unit configured to obtain information relating an amount of the first ink to be discharged in the unit area in the plurality of scans and an amount of the second ink to be discharged in the unit area in the plurality of scans; and a determining unit configured to determine a recording permissibility for the second ink in the plurality of scans based on the amounts of the first and second inks corresponding to the information obtained by the obtaining unit, wherein the recording unit is configured to perform recording with discharging the second ink with the recording permissibility determined by the determining unit.

2. The inkjet recording apparatus according to claim 1, wherein in a case where the information obtained by the obtaining unit represent that a ratio of the second amount to the first amount amount is smaller than a predetermined ratio, the determining unit is configured to determine the recording permissibility such that the sum of the recording permissibility of each scan in the former half of the plurality of scans is larger than the sum of the recording permissibility of each scan of the latter half of the plurality of scans.

3. The inkjet recording apparatus according to claim 1, wherein the second ink contains a resin and the first ink contains no or a smaller amount of resin per unit volume than that of the second ink.

4. The inkjet recording apparatus according to claim 1, wherein the the determining unit is configured to determine the recording permissibility for the second ink in the plurality scans based on the amounts of the first and second inks corresponding to the information obtained by the obtaining unit and the recording unit is configured to perform recording with the recording permissibility determined by the determining unit.

5. The inkjet recording apparatus according to claim 4, wherein, in a case where the information obtained by the obtaining unit represents that a ratio the amount of the second ink to the amount of the first ink is smaller than a predetermined ratio, the determining unit is configured to determine the recording permissibility for the first ink and the recording permissibility for the second ink such that the sum of the recording permissibility of the second ink in the latter half of the plurality of scans is larger than the sum of the recording permissibility of the second ink in the former half of the plurality of scans, and the sum of the recording permissibility of the first ink in the latter half of the plurality of scans is substantially equal to the sum of the recording permissibility of the first ink in the former half of the plurality of scans.

6. The inkjet recording apparatus according to claim 5, wherein the determining unit is configured to determine the recording permissibility for the first ink and the recording permissibility for the second ink using a mask pattern which defines pixels allowing ink discharge and pixels limiting ink discharge in the unit area of each of the plurality of scans.

7. A inkjet recording method using an inkjet recording apparatus, comprising:

discharging from an inkjet head a first ink and a second ink to a unit area of a print medium, wherein the second ink has an ink-remaining likelihood on the first ink higher than an ink-remaining likelihood of the first ink on the second ink;

performing a plurality of scans on the unit area of the print medium for discharging the first and second inks thereon;

obtaining information relating an amount of the first ink to be discharged in the unit area in the plurality of times of scans and an amount of the second ink to be discharged in the unit area in the plurality of scans;

determining a recording permissibility for the second ink in the plurality of times of scans based on the amounts of the first and second inks corresponding to the obtained information;

performing recording with discharging the second ink with the determined recording permissibility.

8. The inkjet recording method according to claim 7, in a case where the information represents that a ratio of the amount of the second ink to the amount of the first ink is smaller than a predetermined ratio, the sum of the recording permissibility of each scan in the former half of the plurality of scans is larger than the sum of the recording permissibility of each scan of the latter half of the plurality of scans.

9. The recording method according to claim 7, wherein the second ink contains a resin and the first ink contains no or a smaller amount of resin per unit volume than that of the second ink.

10. The inkjet recording method according to claim 7, further comprising determining the recording permissibility of the second ink in the plurality of scans based on the amounts of the first and second inks corresponding to the obtained information, and performing recording with discharging the first ink with the determined recording permissibility.

11. The inkjet recording method according to claim 10, wherein, in a case where the obtained information represents that the ratio of the amount of the second ink to the amount of the first ink is smaller than a predetermined ratio, the sum of the recording permissibility of the second ink in the latter half of the plurality of scans is larger than the sum of the recording permissibility of the second ink in the former half of the plurality of scans, and the sum of the recording permissibility of the first ink in the latter half of the plurality of scans is substantially equal to the sum of the recording permissibility in the former half of the plurality of scans.

12. The recording method according to claim 10, further comprising determining the recording permissibility of the first ink using a mask pattern which defines pixels allowing ink discharge in the unit area and pixels limiting ink in the unit area for each of the plurality of scans.

* * * * *